United States Patent [19]

McMahan et al.

[11] Patent Number: 4,691,779

[45] Date of Patent: Sep. 8, 1987

[54] HYDROSTATIC REFERENCED SAFETY-CIRCULATING VALVE

[75] Inventors: Michael E. McMahan; Daniel A. Newman; Donald W. Winslow, all of Duncan; Gary D. Zunkel, Chickasha, all of Okla.

[73] Assignee: Halliburton Company, Duncan, Okla.

[21] Appl. No.: 820,289

[22] Filed: Jan. 17, 1986

[51] Int. Cl.[4] ..... E21B 34/08

[52] U.S. Cl. ..... 166/321; 166/323

[58] Field of Search ..... 166/321, 317, 319, 323, 166/332, 334, 386, 373, 374

[56] References Cited

U.S. PATENT DOCUMENTS

| | | | |
|---|---|---|---|
| 3,779,263 | 12/1973 | Edwards et al. | 137/68 |
| 3,856,085 | 12/1974 | Holden et al. | 166/264 |
| 3,858,649 | 1/1975 | Wray et al. | 166/162 |
| 3,860,069 | 1/1975 | Wray et al. | 166/264 |
| 3,964,305 | 6/1976 | Wray et al. | 73/151 |
| 3,964,544 | 6/1976 | Farley et al. | 166/315 |
| 3,970,147 | 7/1976 | Jessup et al. | 166/250 |
| 3,976,136 | 8/1976 | Farley et al. | 166/264 |
| 4,063,593 | 12/1977 | Jessup | 166/317 |
| 4,064,937 | 12/1977 | Barrington | 166/162 |
| 4,083,409 | 4/1978 | Barrington | 166/320 |
| 4,109,725 | 8/1978 | Williamson et al. | 166/315 |
| 4,113,012 | 9/1978 | Evans et al. | 166/264 |
| 4,258,793 | 3/1981 | McGraw et al. | 166/315 |
| 4,270,610 | 6/1981 | Barrington | 166/317 |
| 4,281,715 | 8/1981 | Farley | 166/317 |
| 4,311,197 | 1/1982 | Hushbeck | 166/373 |
| 4,324,293 | 4/1982 | Hushbeck | 166/317 |
| 4,328,866 | 5/1982 | Zimmerman | 166/317 |
| 4,341,266 | 7/1982 | Craig | 166/317 |
| 4,355,685 | 10/1982 | Beck | 166/240 |
| 4,422,506 | 12/1983 | Beck | 166/324 |
| 4,429,748 | 2/1984 | Beck | 166/324 |
| 4,444,268 | 4/1984 | Barrington | 166/373 |
| 4,445,571 | 5/1984 | Hushbeck | 166/317 |
| 4,448,254 | 5/1984 | Barrington | 166/373 |
| 4,452,313 | 6/1984 | McMahan | 166/373 |
| 4,489,786 | 12/1984 | Beck | 166/374 |
| 4,515,219 | 5/1985 | Beck | 166/374 |
| 4,537,258 | 8/1985 | Beck | 166/374 |
| 4,553,598 | 11/1985 | Meek et al. | 166/321 X |
| 4,557,333 | 12/1985 | Beck | 166/321 X |
| 4,573,535 | 3/1986 | Manke | 166/321 |
| 4,633,952 | 1/1987 | Ringgeberg | 166/336 |

*Primary Examiner*—Stephen J. Novosad
*Assistant Examiner*—Bui, Thuy M.
*Attorney, Agent, or Firm*—James R. Duzan

[57] ABSTRACT

An annulus pressure responsive downhole tool includes a housing with an operating element disposed in the housing. The operating element is movable from a first element position to a second element position relative to the housing. A hydrostatic well annulus pressure referenced annulus pressure responsive first power piston is disposed in the housing and movable from a first to a second position thereof relative to the housing in response to an increase in well annulus pressure. A lower than hydrostatic well annulus pressure referenced annulus pressure responsive second power piston is disposed in the housing and is operatively associated with the operating element for permitting the operating element to move from its first element position to its second element position in response to movement of the second power piston from a first position to a second position thereof relative to the housing. A prevention device is operatively associated with the first and second power pistons for preventing the second power piston from moving to its second position until the first power piston has moved at least part way towards its second position.

65 Claims, 28 Drawing Figures

HYDROSTATIC REFERENCED SAFETY-CIRCULATING VALVE

BACKGROUND OF THE INVENTION

1. Field of the Invention

The present invention relates generally to annulus pressure responsive downhole tools, and particularly to a combination safety-circulating valve operated by a differential area piston referenced to well annulus hydrostatic pressure.

2. Description of the Prior Art

When an oil well is drilled, it is often desired to test the production capabilities of the subsurface formations intersected by the well by lowering a testing string into the borehole to the formation depth. The formation fluid is then allowed to flow into the test string in a controlled testing program.

It is now well known in the art to operate one or more of the tools in the test string in response to increases in well annulus pressure in a well annulus between the test string and the well borehole. This is often far superior to using pipe manipulation through rotation or reciprocation to operate the testing tools, particularly in deviated boreholes such as are drilled from offshore platforms.

One testing tool which is commonly included in the test string is a combination safety and circulating valve.

Such a combination safety and circulating valve which has been utilized by the assignee of the present invention is disclosed in U.S. Pat. Nos. 4,270,610 to Barrington, 4,311,197 to Hushbeck, and 4,445,571 to Hushbeck.

The device shown in the three patents just referenced is generally referred to as a combination sampler valve and circulation valve. The term sampler is utilized because the tool disclosed in these three patents utilizes two spaced ball valves which can trap a sample of the flowing fluid therebetween. The ball valves themselves, however, can also be referred to as safety valves since they operate to shut off the flow of well fluid through the test string.

Although the apparatus disclosed in the present application includes only a single ball type safety valve, it will be understood that it could be modified to add a second ball and thus be a sampler valve, and the prior art sampler valves disclosed in the three patents referenced above could have the lower ball thereof eliminated so that they would then provide only a safety valve and circulating valve.

The prior art combination sampler and circulation valve disclosed in the three patents cited above is referred to as an atmospheric referenced tool. That is, the differential area piston which operates that tool has a low pressure side exposed to substantially atmospheric pressure. Referring for example to U.S. Pat. No. 4,270,610 to Barrington, and particularly to FIG. 2B thereof, a sealed low pressure chamber 80 is thereshown which contained air at atmospheric pressure when the tool was first assembled before running into the well. Although that pressure may change due to heating or cooling after the tool is placed in a well, this is still generally referred to as an atmospheric referenced tool.

The tool shown in FIGS. 2A–2F of U.S. Pat. No. 4,270,610 is utilized in a test string as illustrated in FIG. 1 of that patent, and generally has an annulus pressure responsive tester valve located in the same string therebelow.

Generally, the test string is lowered into a well, and then after a packer of the test string is set, well annulus pressure may be repeatedly increased and then dropped back to hydrostatic pressure to operate the well tester valve located below the combination sampler-circulating valve. The sampler-circulating valve is designed to operate at a higher differential pressure between the well annulus and the interior of the test string than is the tester valve located therebelow.

After the testing program is completed, well annulus pressure is then increased to the higher level necessary to operate the sampler-circulating valve, and the two ball valves of the sampler section will then be closed to trap a flowing sample of well fluid and to close the bore of the test string against further flow of well fluid therethrough while at substantially the same time a circulating valve above the sample chamber is opened to communicate the interior of the test string with the well annulus.

The power mandrel of the combination sampler-circulating valve of U.S. Pat. No. 4,270,610 is retained in place against premature operation by a shear set 100 seen in FIG. 2B thereof which includes a large plurality of shear pins 112. The shear set is designed to shear when the difference between well annulus pressure and pressure interior of the test string reaches a predetermined level at which it is desired to operate the sampler-circulating valve.

The shear pins of the shear set must be designed to hold against the hydrostatic well annulus pressure plus the increase in well annulus pressure which is utilized to operate the tool. This increase in well annulus pressure is generally in the range of 1500 to 2500 psi.

As will be well understood by those skilled in the art, the hydrostatic well annulus pressure which is present due merely to the weight of the drilling mud contained in the well bore may itself be on the order of 10,000 psi. Thus, the shear pins of the shear set 100 of the U.S. Pat. No. 4,270,610 must be designed to hold the power mandrel in place against the difference between hydrostatic well annulus pressure of perhaps 10,000 psi and the substantially zero pressure in chamber 80 for long periods of time during the testing program, and must then reliably fail at an increased pressure differential of 1500 to 2500 psi.

Thus, the shear pins of the shear set must support 80% to 90% of the designed shearing load for long periods of time while being subjected to high temperatures, and often to corrosive environments in the well. It is common for brass shear pins to stress crack due to corrosion caused by ammonia present in the well.

This leads to substantial problems due to inconsistent operating pressures of tools such as those shown in U.S. Pat. No. 4,270,610.

The problem is due in part to the variation in shear strength of the shear pins themselves which are generally constructed of brass. Quality control requirements governing the production of the pins is very stringent, but if a large number of pins is required to be used on a job, such as illustrated in FIG. 2B of the U.S. Pat. No. 4,270,610, the actual shear pressure may be significantly different than calcuated.

Additionally, the number of pins required for a specific job is determined by the depth at which the tool is run and the mud weight, that is the weight of the drilling fluid contained in the well. Many times the mud weight value may be incorrectly stated and therefore calculations can be off considerably.

The design of the U.S. Pat. No. 4,270,610 therefore depends heavily upon the shear pins for proper operation, where in fact many variables exist which can substantially alter the operating pressure of the tool at which the shear pins will shear.

The reason so many shear pins are required in tools such as those shown in U.S. Pat. No. 4,270,610 is that the tools are referenced to substantially atmospheric conditions and thus the pins must resist the hydrostatic well annulus pressure plus approximately 2500 psi.

Additionally, although the design of U.S. Pat. No. 4,270,610 using a large number of pins most often has a problem with too low of an operating pressure due to deterioration of the pins as described, it can also have a problem with too high of an operating pressure due to a build-up of tolerances in construction of the pins.

SUMMARY OF THE INVENTION

The present invention overcomes many of the problems just discussed which are present in tools such as that shown in U.S. Pat. No. 4,270,610 by referencing the operation of the tool to hydrostatic well annulus pressure instead of to atmospheric pressure. This greatly reduces the number of shear pins which must be utilized, and makes the predetermined operating pressure of the tool much more consistent.

The present invention provides an annulus pressure responsive downhole tool apparatus including a housing having an operating element means disposed in the housing and movable from a first element position to a second element position relative to the housing.

Although this operating element means is disclosed as a combination safety-circulating valve, it will be understood that the operating element means could be in any number of configurations, such as merely a circulating valve, or such as a combination sampler-circulating valve.

A hydrostatic well annulus pressure referenced annulus pressure responsive first piston means is disposed in the housing, and is movable from a first to a second position thereof relative to the housing in response to an increase in well annulus pressure.

A second annulus pressure responsive piston means is disposed in the housing and is generally referenced to a lower than hydrostatic pressure. This second piston is preferably referenced to substantially atmospheric pressure. The second piston is operatively associated with the operating element means for permitting the operating element means to move from its first element position to its second element position in response to movement of the second piston means from a first position toward a second position thereof relative to the housing.

A prevention means is operatively associated with the first and second piston means for preventing the second piston means from moving to its second position until the first piston means has moved at least part way toward its second position.

Numerous objects, features and advantages of the present invention will be readily apparent to those skilled in the art upon a reading of the following disclosure when taken in conjunction with the accompanying drawings.

BRIEF DESCRIPTION OF THE DRAWINGS

FIGS. 4A–4I comprise an elevation right-side only sectioned view of a third embodiment of the present invention.

FIGS. 4E–4I can be considered to be a continuation of the structure shown in FIGS. 5A–5D.

DETAILED DESCRIPTION OF THE PREFERRED EMBODIMENTS

Figure 1A:
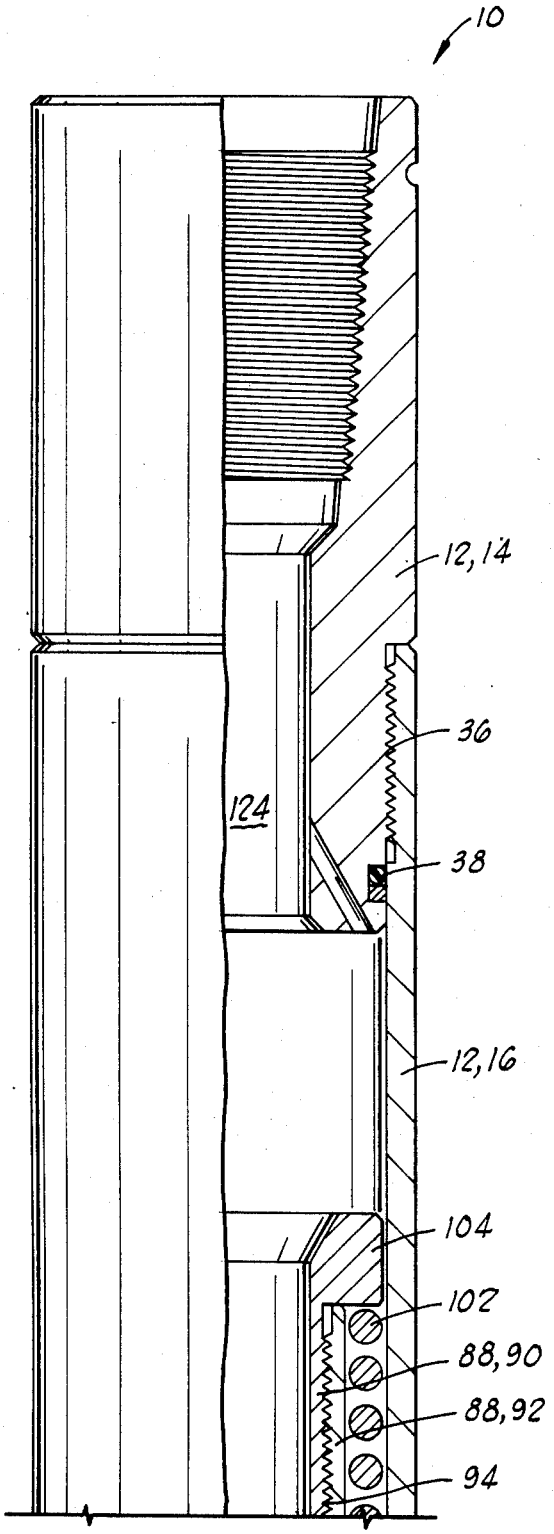
FIGS. 1A–1F comprise an elevation right-side only section view of a first embodiment of the combination safety-circulating valve of the present invention.

Referring now to the drawings, and particularly to FIGS. 1A–1F, a first embodiment of the combination safety-circulating valve apparatus of the present invention is thereshown and generally designated by the numeral 10.

The apparatus 10 can generally be referred to as an annulus pressure responsive downhole tool apparatus 10, and it includes a housing 12. The housing 12 is comprised of an upper adapter 14, a spring housing section 16, a circulating valve housing section 18, a ball valve housing section 20, an upper power housing section 22, a shear set housing section 24, a lower power housing section 26, a filler housing section 28, an equalizing chamber housing section 30 having inner and outer tubular members 32 and 34, and a lower adapter 36.

Upper adapter 14 and spring housing section 16 are threadedly connected at 36 with a seal being provided therebetween by O-ring means 38.

The lower end of spring housing section 16 is connected to circulating valve housing section 18 at threaded connection 40 with a seal being provided therebetween by O-ring means 42.

The circulating valve housing section 18 has its lower end connected to ball valve housing section 20 at threaded connection 44 with a seal being provided therebetween by O-ring 46.

A lower end of ball valve housing section 20 is connected to upper power housing section 22 at threaded connection 48 with a seal being provided therebetween by O-ring 50.

The lower end of upper power housing section 22 is connected to shear set housing section 24 at threaded connection 52 with a seal being provided therebetween by O-ring 54.

The shear set housing section 24 has its lower end connected to lower power housing section 26 at threaded connection 56 with a seal being provided therebetween by O-ring 58.

The lower end of lower power housing section 26 is connected to filler housing section 28 at threaded connection 60 with a seal being provided therebetween by O-ring 62.

Filler housing section 28 has its lower end connected to outer tubular member 34 of equalizing chamber housing section 30 at an outer threaded connection 64 with a seal being provided therebetween by O-ring 66.

Filler housing section 28 also has its lower end connected to inner tubular member 32 of equalizing chamber housing section 30 at inner thread 68 with a seal being provided therebetween by O-ring 70.

The lower end of outer tubular member 34 is connected to lower adapted 36 at threaded connection 72 with a seal being provided therebetween by O-ring 74.

Inner tubular member 32 has its lower end 76 closely received within a bore 78 of lower adapter 36 with a seal being provided therebetween by O-ring 80.

The apparatus 10 includes a full open ball type safety valve means generally designated by the numeral 82 and a sliding sleeve type circulating valve means generally designated by the numeral 84. The safety valve means 82 and circulating valve means 84 may be collectively referred to as an operating element means 86.

Figure 1B:
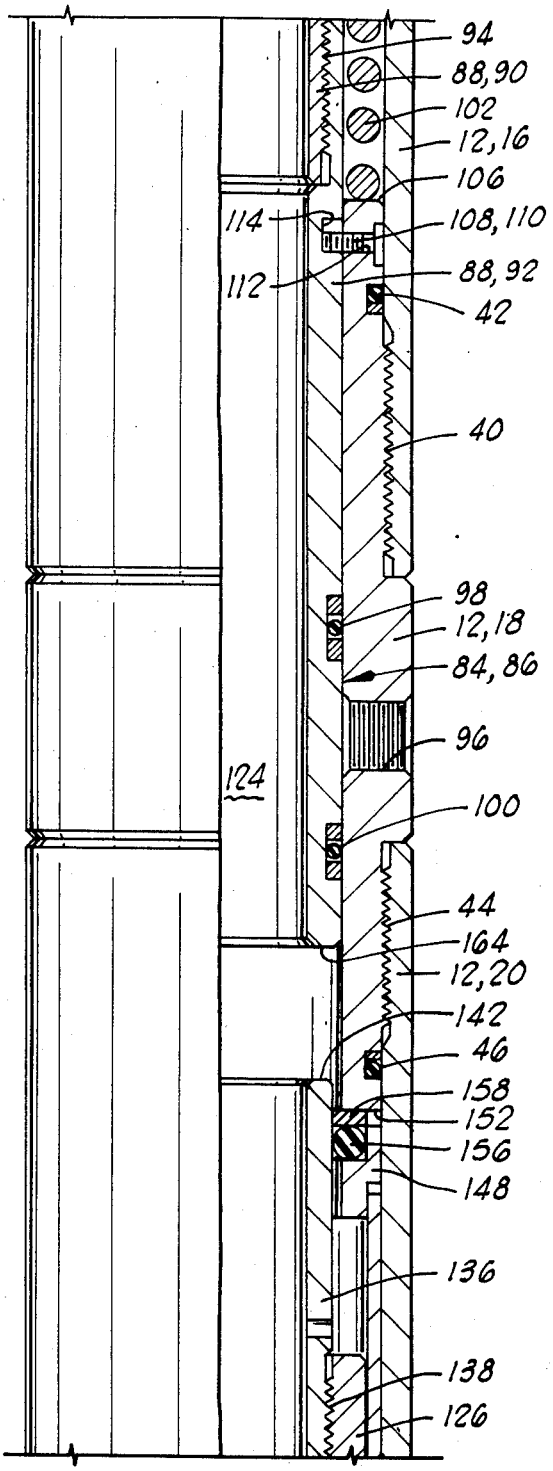
Figure 1C:
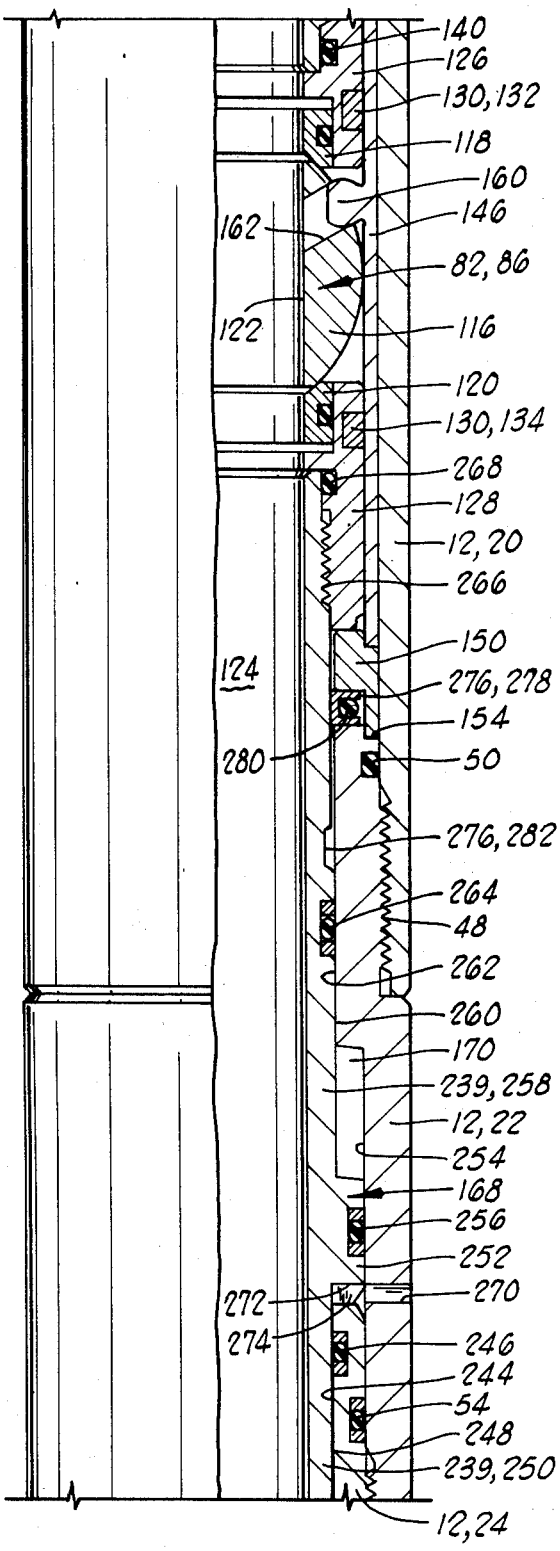

The operating element means 86 is shown in FIGS. 1A–1C in what may generally be referred to as a first element position of the operating element means 86. In this first element position of operating element means 86, the safety valve means 82 is in an open position and the circulating valve means 84 is in a closed position.

As is further described below, the operating element means 86 is movable to a second element position relative to the housing 12, wherein the safety valve means 82 is closed and the circulating valve means 84 is open.

The circulating valve means 84 includes a circulating valve sleeve 88 comprised of upper and lower portions 90 and 92 threadedly connected together at threaded connection 94.

The circulating valve sleeve 88 is initially located in a closed position as shown in FIG. 1B wherein the lower portion 92 thereof blocks or closes a circulating port 96 disposed through circulating valve housing section 18 of housing 12.

Lower portion 92 of circulating valve sleeve 88 has upper and lower longitudinally spaced annular seals 98 and 100 which are located on opposite sides of circulating port 96 when the circulating valve means 84 is in its closed position as shown in FIGS. 1A–1B.

Circulating valve means 84 also includes a coil compression spring biasing means 102 which is initially compressed between a radially outward extending annular flange 104 of upper portion 90 and an upper end surface 106 of circulating valve housing section 18.

A releasable retaining means 108 is provided for initially releasably retaining the circulating valve sleeve 88 in its closed position. Releasable retaining means 108 includes one or more shear pins 110 disposed through radial bores such as 112 in circulating valve housing section 18 and received within an annular groove 114 of lower portion 92 of circulating valve sleeve 88.

The safety valve means 82 includes a full opening ball valve 116 received between upper and lower annular seats 118 and 120. The ball valve 116 has a bore 122 which is initially aligned with and defines a portion of a longitudinally extending full opening flow passage 124 disposed through the apparatus 10.

The upper and lower seats 118 and 120 are received within bores of upper and lower seat holders 126 and 128, respectively. The upper and lower seat holders 126 and 128 are held in place relative to each other by a plurality of C-clamps such as the C-clamp 130 which has its upper and lower ends 132 and 134 shown in FIG. 1C.

An actuating mandrel 136 is connected to upper seat holder 126 at threaded connection 138 with a seal being provided therebetween by O-ring 140.

The safety valve means 82 includes a pair of actuating arms, only one of which is shown and designated by the numeral 146. The actuating arm 146 is held in place longitudinally relative to ball valve housing section 20 by upper and lower annular inserts 148 and 150 which are longitudinally trapped between a lower end 152 of circulating valve housing section 18 and an upper end 154 of upper power housing section 22.

A shock absorbing O-ring 156 and a spacer washer 158 are disposed between lower end 152 of circulating valve housing section 18 and the upper insert 148.

The actuating arm 146 includes a radially inward extending actuating lug 160 received in an eccentric bore 162 of ball valve 116.

There are in fact two such actuating arms 146 circumferentially spaced about the ball valve 116, each of which includes a lug like 160 engaging an eccentric bore like 162, so that when the ball valve member 116 is moved longitudinally upward from the position shown in FIG. 1C relative to housing 12, the ball valve 116 will be rotated to a closed position wherein its bore 122 is oriented at an angle of 90° to the longitudinal flow passage 124 disposed through the apparatus 10.

As will be further described in detail below, the ball valve 116 will be rapidly pushed irreversibly upward relative to the housing 12 in response to an increase in well annulus pressure.

When that occurs, the actuating mandrel 136 will also move longitudinally upward relative to the housing 12 and an upper end 142 of actuating mandrel 136 will impact a lower end 164 of lower portion 92 of circulating valve sleeve 88 to shear the shear pin 110 and allow the circulating valve sleeve 88 to be irreversibly moved upward to an open position by expansion of the coil compression spring 102, thus moving the lower end 164 of lower portion 92 of circulating valve sleeve 88 upward to a position above the circulating port 96 thus opening the circulating port 96 to provide communication between the flow passage 124 and the well annulus exterior of the housing 12.

Figure 1D:
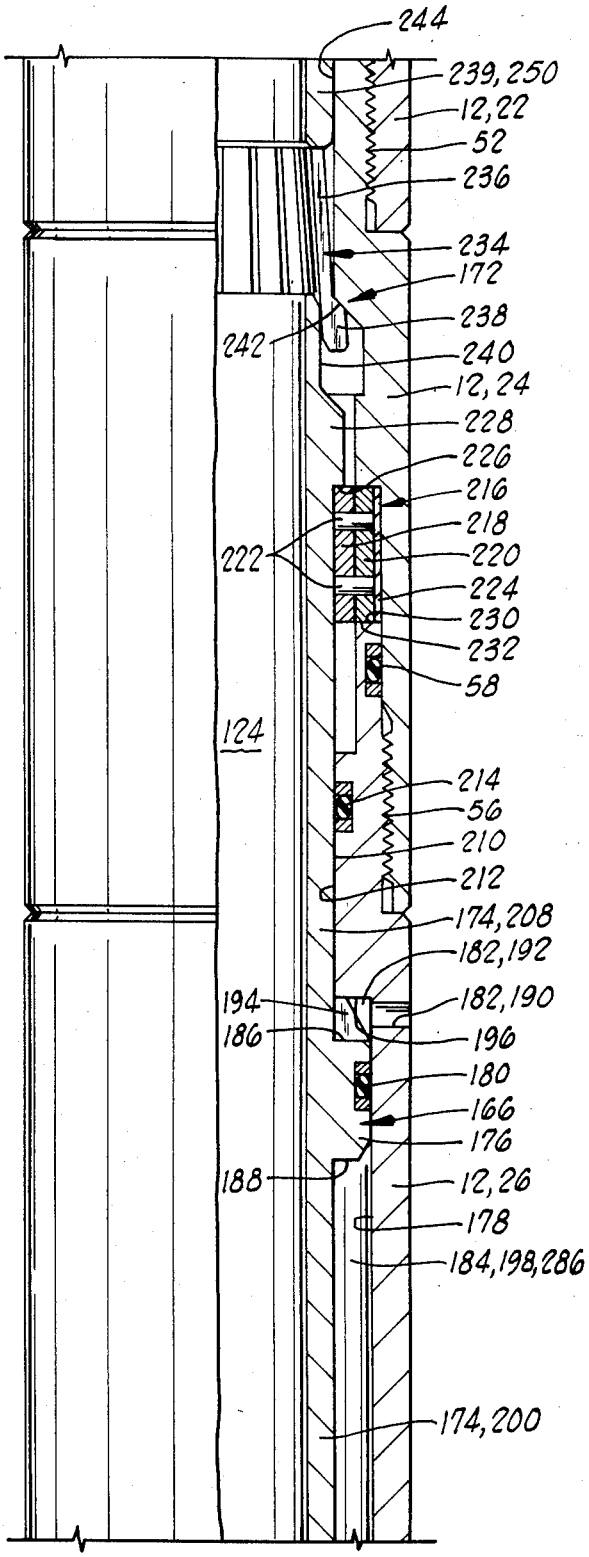

The apparatus 10 includes a lower first power piston means 166 seen in FIG. 1D, and an upper second power piston means 168 seen in FIG. 1C.

The first piston means 166 can generally be described as a hydrostatic referenced annulus pressure responsive first power piston means 166. By hydrostatic referenced, it is meant that the power piston 166 will operate in response to a pressure differential between a hydrostatic well annulus pressure at the depth at which the apparatus 10 is located in the well, and an artificially increased well annulus pressure which is applied to operate the tool. This is further described in detail below.

The second piston means 168 can generally be described as a lower than hydrostatic referenced annulus pressure responsive second piston means 168.

The second piston means 168 is preferably referenced to substantially atmospheric pressure contained in a sealed low pressure chamber 170 seen in FIG. 1C.

A prevention means generally designated by the numeral 172 is operatively associated with the first and second piston means 166 and 168 for preventing the second piston means 168 from moving from its first position as seen in FIGS. 1C–1D to an upper second position, until the first piston means 166 has moved at least part way from its upper first position seen in FIG. 1D to a lower second position relative to the housing 12. This too is described in substantially greater detail below.

The second power piston means 168 can generally be described as being operatively associated with both the safety valve means 82 and circulating valve means 84 of the operating element means 86 for permitting the operating element means 86 to move from a first element position wherein the safety valve means 82 is open and the circulating valve means 84 is closed to a second element position wherein the safety valve means 82 is closed and the circulating valve means 84 is open in response to movement of the second piston means 168 upward from its first position shown in FIG. 1C to an upper second position relative to the housing 12.

The first power piston means 166 includes an elongated first power mandrel 174 having an enlarged diameter piston 176 defined thereon which is closely slidably received within a bore 178 of lower power housing section 26. A sliding piston seal 180 is received in the enlarged piston 176 and sealingly engages the bore 178.

The housing 12 has first and second pressure conducting passage means 182 and 184, respectively, disposed therein for communicating a well annulus exterior of the housing 12 with a first upper side 186 and a second lower side 188 of the piston 176 of first piston means 166. The upper first side 186 can generally be referred to as a high pressure side, and the lower second side 188 can generally be referred to as a low pressure side of the piston 176.

The first pressure conducting passage means 182 includes a first power port 190 disposed radially through lower power housing section 26, and an annular space 192 defined between first power mandrel 174 and bore 178 above piston 176.

The first piston means 166 includes a plurality of integrally formed upward extending ridges 194 which abut a downward facing shoulder 196 of lower power housing section 26.

The second pressure conducting passage means 184 includes an annular space 198 defined between a lower portion 200 of first power mandrel 174 and the bore 178 of lower power housing section 26.

Second pressure conducting passage means 184 also includes a plurality of longitudinally extending bores 202 disposed through filler housing section 28.

An annular equalizing chamber 204 defined between the inner and outer tubular portions 32 and 34 of equalizing chamber housing section 30 is also included in second pressure conducting passage means 184.

The longitudinal bores 202 communicate annular space 198 with annular equalizing chamber 204. A lower end of equalizing chamber 204 is communicated with the well annulus by an equalizing port 206 of second pressure conducting passage means 184.

The lower portion 200 of first power mandrel 174 has a lower end 201 with a cylindrical outer surface 203 closely received within an upper bore 205 of filler housing section 28 with a seal being provided therebetween by O-ring 207.

The first power mandrel 174 has an upper portion 208 which has a cylindrical outer surface 210 thereof closely slidably received within a bore 212 of lower power housing section 26 with a seal being provided therebetween by O-ring 214.

A releasable retaining means 216 is operably associated with the upper power mandrel portion 208 of first piston means 166 for holding the first piston means 166 in its first position as seen in FIG. 1D until a pressure differential across the piston 176 thereof reaches a predetermined value.

The releasable retaining means 266 in the illustrated embodiment is a shear set consisting of inner and outer concentric sleeves 218 and 220, respectively, with a plurality of shear pins such as 222 received in aligned radial bores disposed through the sleeves 218 and 220. A retaining sleeve 224 is disposed about the outer sleeve 220 to hold the pins 222 in place.

A downward facing annular shoulder 226 of an enlarged diameter portion 228 of first power mandrel 174 engages the upper end of inner sleeve 218, while an upper end 230 of lower power housing section 26 engages a lower end 232 of outer sleeve 220 so that a downward load placed upon first piston means 166 will be placed in shear across the shear pins 222.

If shear pins are undesirable in a particular tool, other constructions of the releasable retaining means 216 can be utilized. For example, a ring spring type retaining device could be utilized. Additionally, individual shear pins like the shear pins 726 shown in FIG. 4D and discussed below could be utilized instead of the shear set 216. Other types of retaining means could also be utilized.

The prevention means 172 seen in the upper portion of FIG. 1D is, in the embodiment of FIGS. 1A–1F, a releasable mechanical locking means 172 for releasably locking the second piston means 168 in its lowermost first position as seen in FIGS. 1C–1D so long as the first piston means 166 is in its uppermost first position as seen in FIG. 1D.

The releasable mechanical locking means 172 includes a spring collet 234 connected to the second piston means 168 and including a plurality of downward extending spring fingers such as 236 each of which has an enlarged lug 238 on the lower end thereof. In the embodiment shown in FIGS. 1C–1D, the spring collet 234 is constructed as an integral part of a second power mandrel 239 of second piston means 168.

The housing 12, the first and second piston means 166 and 168, and the spring collet 234 are so arranged and constructed that when the first piston means 166 is in its uppermost first position as seen in FIG. 1D, an upper cylindrical outer surface 240 of first power mandrel 174 engages the spring fingers 236 and holds the lugs 238 thereof in a radially outward position wherein the lugs 238 engage a radially inner downward facing tapered shoulder 242 of shear set housing section 24. When the first piston means 166 moves downward relative to housing 12, the outer surface 240 thereof will move downward out of engagement with the spring fingers 234 thus releasing the spring fingers 234 and the lugs 238 thereof so that the spring fingers 234 may deflect radially inward to allow the second power mandrel 239 and the spring collet 234 to move upward through a central bore 244 of shear set housing section 24.

An O-ring 246 provides a sliding seal between an outer surface 248 of a lower portion 250 of second power mandrel 239 and the bore 244.

The second piston means 168 includes the second power mandrel 239 and an enlarged diameter second power piston 252 which is closely received within a bore 254 of upper power housing section 22. A piston seal 256 provides a sliding seal between enlarged diameter piston 252 and bore 254.

An upper portion 258 of second power mandrel 239 has a cylindrical outer surface 260 which is closely and slidably received within a reduced diameter bore 262 of upper power housing section 22 with a seal being provided therebetween by sliding O-ring 264.

The upper end of second power mandrel 239 is connected to lower seat holder 128 at threaded connection 266 with a seal being provided therebetween by O-ring 268.

Upper power housing section 22 has a second power port 270, which may also be generally described as a power passage 270, disposed therethrough which always communicates the well annulus exterior of the housing 12 with a lower high pressure side 272 of piston 252 of second piston means 168.

The second piston means 168 includes a plurality of ridges 274 extending downward from piston 252 to prevent the lower side 272 of piston 252 from abutting the upper end of shear set housing section 24.

The sealed low pressure chamber 170 previously mentioned is defined between outer surface 260 of upper portion 258 of second power mandrel 239 and the bore 254 of upper power housing section 22 between seals 264 and 256. As previously mentioned, the low pressure chamber 170 is generally filled with air at substantially atmospheric pressure when the tool 10 is assembled at the surface of the earth.

When a downward pressure differential across first piston means 166 is sufficiently large to shear the shear pins 222, the first piston means 166 moves downward thus releasing the prevention means 172 and allowing the second piston means 168 to be moved upward by the upward acting pressure differential between the well annulus and the low pressure chamber 170.

This pushes the entire safety valve assembly 82 upward relative to housing 12 thus rotating the ball valve 116 thereof to a closed position.

This upward motion also impacts the actuating mandrel 136 with the circulating valve sleeve 88 to shear the shear pins 110 and allow the circulating valve sleeve 88 to be moved upward by spring 102 to open the circulating port 96.

A locking means 276 is operably associated with the housing 12 and the upper portion 258 of second power mandrel 239 of second piston means 168 for locking the second piston means 168 in its uppermost second position. The locking means 276 includes a plurality of segmented locking dogs 278 biased radially inward by an annular resilient band 280.

When the second piston means 168 is in its uppermost second position, a radially outer annular groove 282 thereof receives the locking dogs 278 therein to lock the second piston means 168 in place relative to the housing 12.

Figure 1E:
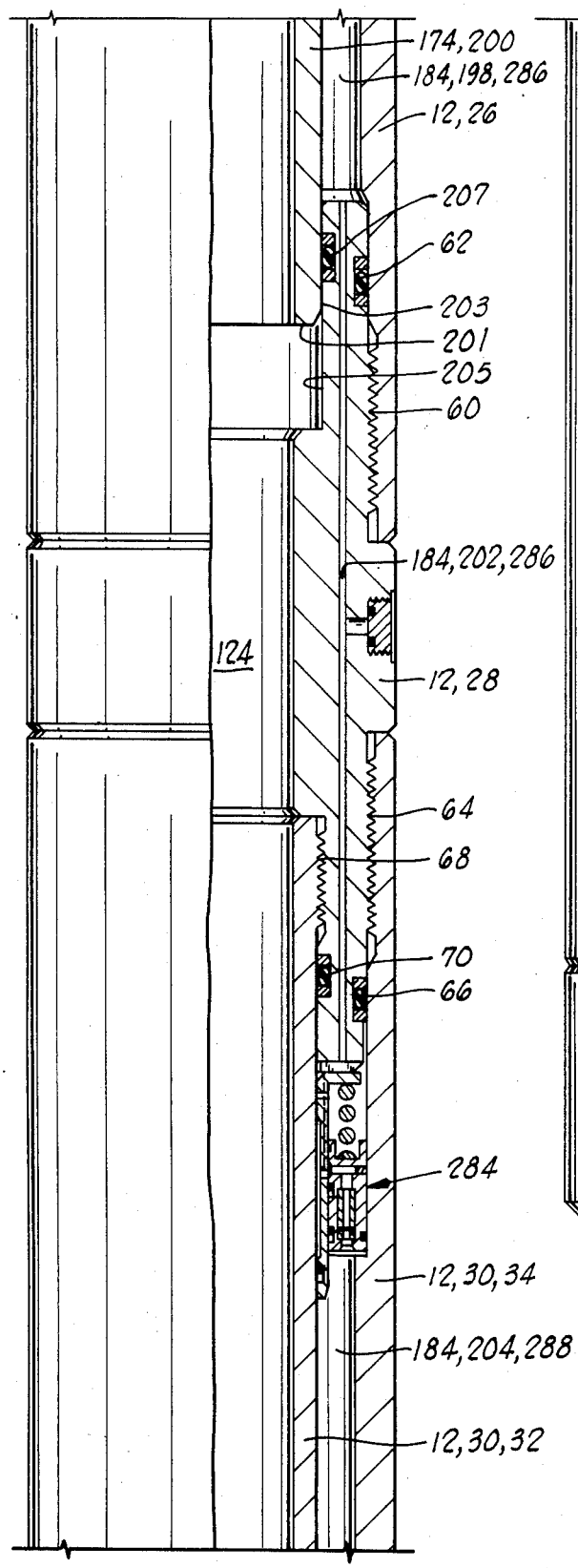

A retarding means generally designated by the numeral 284 is disposed in the second pressure conducting passage 184 of housing 12 as seen in the lower portion of FIG. 1E. The retarding meand 284 is shown in a greatly enlarged view in FIG. 2.

The retarding means 284 can generally be described as a means for delaying communication of a sufficient portion of a relatively rapid increase in well annulus pressure to the low pressure side 188 of first piston means 166 for a sufficient time to allow a downward pressure differential across first piston means 166 to move the first piston means 166 from its first position as illustrated in FIGS. 1D–1E to a lower second position.

The retarding means 284 can also be generally described as a means for communicating a relatively slow increase in well annulus pressure to the low pressure side 188 of first piston means 166 quickly enough that a downward pressure differential across first piston means 166 is too low to move the first piston means 166 from its first position to a lower second position, so that hydrostatic well annulus pressure may be substantially balanced across first piston means 166 as the apparatus 10 is lowered into a well.

As previously mentioned, the downward pressure differential which must be placed across first piston means 166 to move it downward from the first position illustrated in FIGS. 1D–1E is determined by the construction of the releasable retaining means 216.

Due to the fact that the retarding means 284 allows relatively slow increases in well annulus pressure to be metered through to the lower side 188 of first piston means 166, to thereby balance hydrostatic well annulus pressure across the first piston means 166 as the apparatus 10 is lowered into a well, the retarding means 284 can be said to be a means for preventing the releasable retaining means 216 from having any substantial force applied thereacross as a result of increasing hydrostatic well annulus pressure as the apparatus 10 is lowered into a well.

Figure 2:
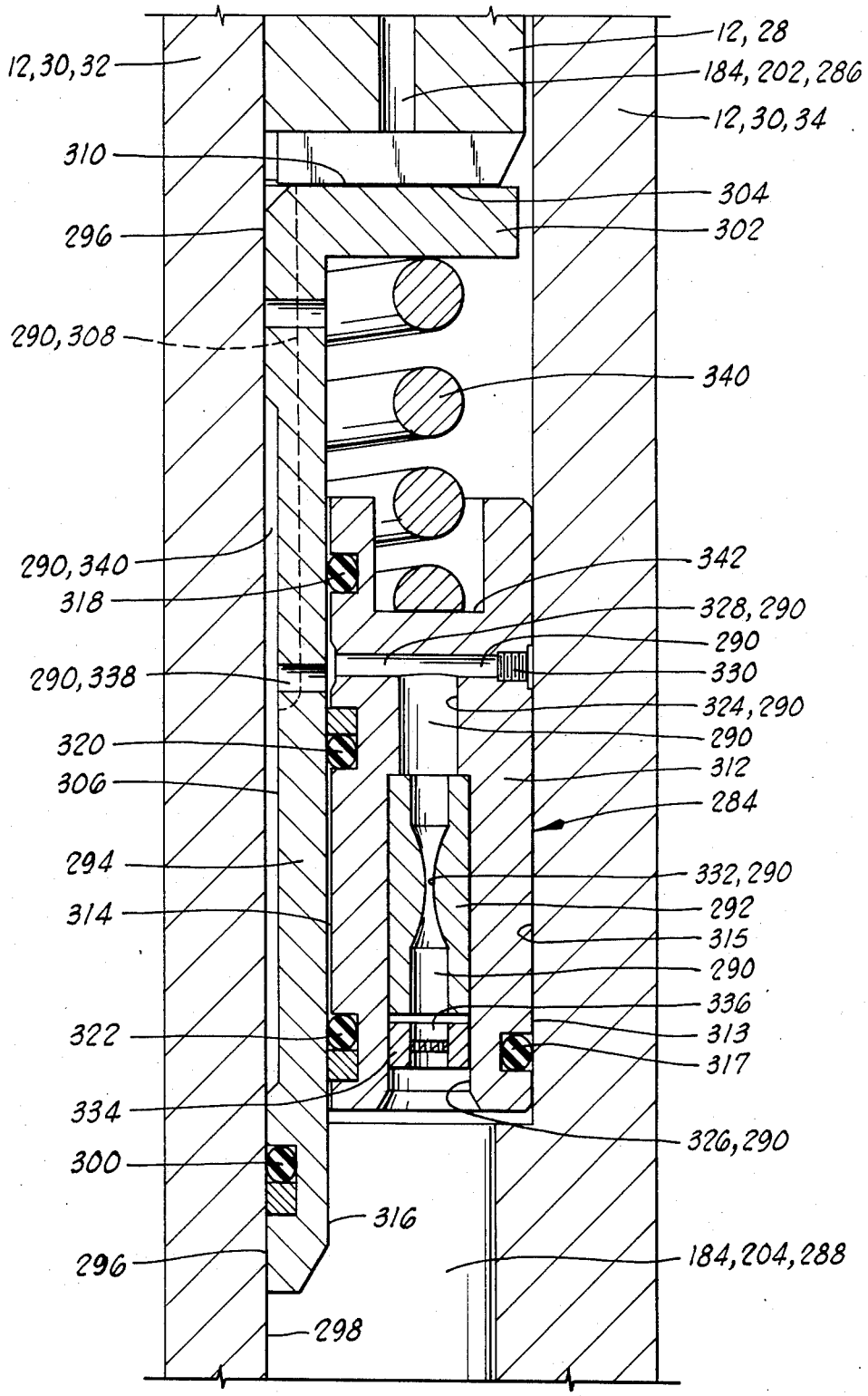
FIG. 2 is an enlarged elevation sectioned view of a metering check valve utilized in the apparatus of FIGS. 1A–1F.

The particular embodiment of the retarding means 284 shown in FIG. 2 can generally be described as a metering cartridge 284 which divides the second pressure conducting passage means 184 into an upper first portion 286 between the lower second side 188 of first piston means 166 and the metering cartridge 184, and a lower second portion 288 between the metering cartridge 284 and the well annulus.

The metering cartridge 284 has a pressurizing passage 290 disposed therethrough which communicates the first and second portions 286 and 288 of second pressure conducting passage means 184.

Metering cartridge 284 includes a fluid flow restrictor means 292 disposed in the pressurizing passage 290 for at least temporarily delaying transmission of relatively rapid increases in well annulus pressure to the lower second side 188 of first piston means 166.

The particular embodiment of metering cartridge 284 shown in FIG. 2 can also generally be described as a selectively actuatable one-way check valve means 284 associated with the second pressure conducting passage means 184 for preventing flow of fluid from the well annulus to the lower second side 188 of first piston means 166 so that after the check valve 284 is actuated, an increase in well annulus pressure will create a pressure differential from the first side 186 toward the second side 188 of first piston means 166.

The retarding means or check valve means 284 includes a cylindrical inner body 294 having a bore 296 disposed therethrough. A cylindrical outer surface 298 of inner tubular member 32 of equalizing chamber housing section 30 is closely received within bore 296 and an O-ring seal 300 is provided therebetween.

Body 294 includes a radially outward extending flange 302 on the upper end thereof which abuts a lower end 304 of filler housing section 28.

Body member 294 includes an enlarged internal diameter surface 306 along an intermediate portion thereof. A plurality of longitudinally extending radially inner grooves 308 are indicated in dashed lines as communicating an upper end 310 of body 294 with the enlarged inner diameter surface 306.

Retarding means 284 includes a sliding check valve member 312 having a bore 314 slidably received about a cylindrical external surface 316 of body 294 with three sliding seals being provided therebetween by O-rings 318, 320 and 322.

Sliding check valve member 312 includes a cylindrical outer surface 313 slidably received within a bore 315 of outer tubular member 34 of equalizing chamber housing section 30 with a seal being provided therebetween by O-ring 317.

Sliding check valve member 312 includes a longitudinal bore 324 and counterbore 326 disposed therein. The upper end of bore 324 communicates with a radial bore 328 disposed through sliding check valve member 312. Radial bore 328 is closed by a threaded plug 330 at its outer end.

The fluid flow restrictor 292 is received within the counterbore 326.

The fluid flow restrictor 292 has a restricted area flow passage 332 disposed therethrough.

A filter screen 334 is received in counterbore 326 below the fluid flow restrictor 292.

The pressurizing passage 290 previously described as being disposed through the retarding means 284 includes the counterbore 326, a bore 336 through filter 334, the restricted area flow passage 332 through fluid flow restrictor 292, the longitudinal bore 324, the radial bore 328, a radial bore 338 disposed through body member 294, an annular space 340 between inner tubular member 32 and enlarged diameter inner surface 306, and the longitudinal grooves 308.

The retarding means 284 includes a coil compression spring biasing means 340 disposed between flange 302 of body member 294 and an upper end surface 342 of sliding check valve member 312. The spring 340 biases the sliding check valve member 312 toward a lower first position as illustrated in FIG. 2 wherein the radial bore 338 of body member 294 is located between first and second seals 318 and 320 so that the pressurizing passage 290 is open to flow therethrough.

The restricted area flow passage 332 permits relatively slow increases in well annulus pressure to be transmitted therethrough to the lower second side 188 of first piston means 166, because relatively slow pressure increases such as are encountered when the apparatus 10 is lowered into a well can be transferred by a relatively small rate of fluid flow through the restricted area flow passage 332 so that an upward pressure differential acting on sliding check valve member 312 as a result of the restricted area flow passage 332 is never sufficient to overcome the downward bias of spring 340.

If, however, a relatively rapid increase in well annulus pressure is experienced, as will be the case when a tester valve located in the testing spring is tested, or when it is desired to operate the combination safety valve and circulating valve apparatus 10 of the present invention, fluid flow through the restricted area flow passage 332 cannot proceed at a fast enough rate to permit that pressure increase to be transferred therethrough. Instead, the restricted area flow passage 332 delays communication of such a relatively rapid increase in well annulus pressure therethrough so as to create an upward pressure differential across the sliding check valve member 312 sufficient to overcome the spring biasing means 340 and move the sliding check valve member 312 to an upper second position wherein second seal 320 is located above radial bore 338 of body member 294 thus closing the pressurizing passage 290 to prevent any further flow of fluid from the well annulus therethrough to the second side of the first piston means 166.

The spring 340 seen in FIG. 2 is preferably designed such that when a relatively rapid well annulus pressure increase in excess of about 500 to about 600 psi is provided, the spring 340 will compress thus allowing the sliding check valve member 312 to move to a closed position.

Figure 1F:
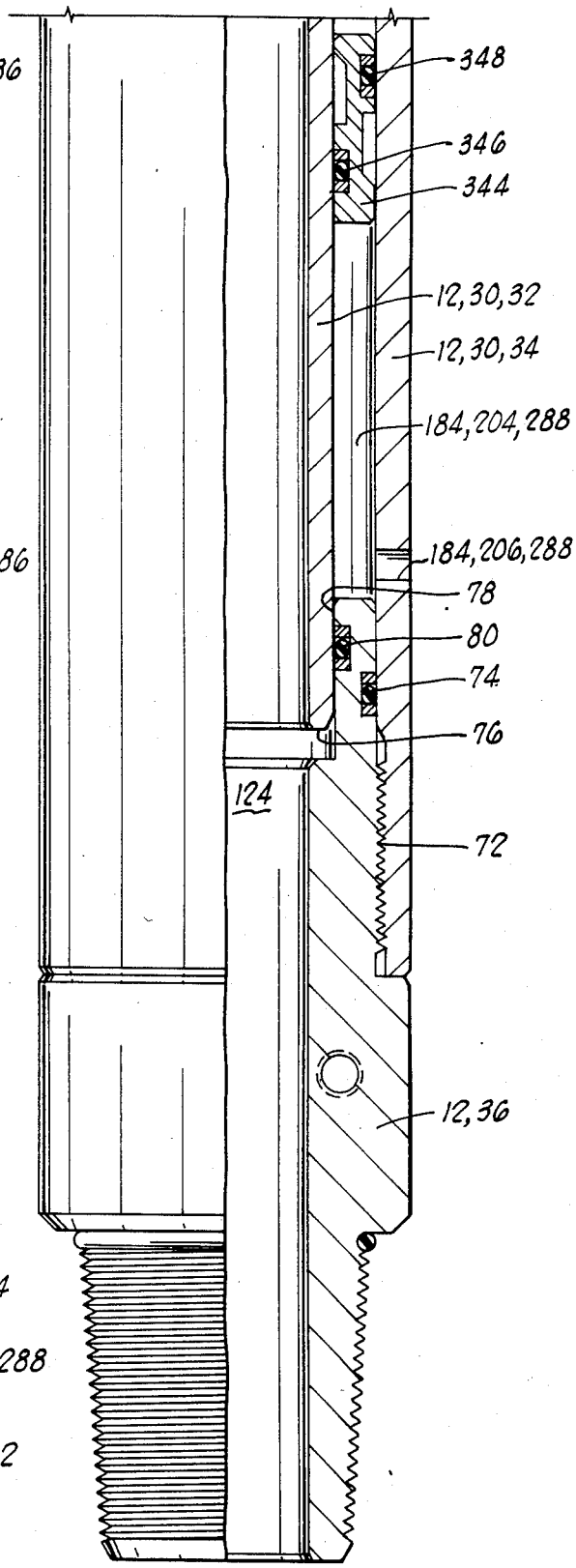

Referring now to FIG. 1F, the annular space 204 has a floating piston 344 received therein which has inner and outer seals 346 and 348, respectively, which seal between the floating piston 344 and the inner and outer tubular members 32 and 34, respectively, of equalizing chamber housing section 30.

The annular space 204 above floating piston 344 and all those other portions of the second pressure conducting passage means 184 between floating piston 344 and the lower side 188 of first piston means 166 is filled with a liquid, preferably silicone oil. It is this silicone oil which meters through the restricted area flow passage 332. Additionally, the slight compressibility of the silicone oil located in the upper first portion 286 of second pressure conducting passage means 184 between the first piston 166 and the meteing cartridge 284 provides the necessary decrease in volume of that fluid to allow the first piston means 166 to move downward under its designed operating pressures.

The floating piston 344 separates this silicone oil from well fluid which enters the equalizing port 206.

OPERATION OF THE EMBODIMENT OF FIGS. 1A–1F AND FIG. 2

The combination safety and circulating valve apparatus 10 shown in FIGS. 1A–1F and FIG. 2 is assembled in a well test string like that shown in FIG. 1 of U.S. Pat. No. 4,270,610 to Barrington, the details of which are incorporated herein by reference. As described in the Barrington U.S. Pat. No. 4,270,610, the combination safety-circulating valve would generally be located in the position indicated by the numeral 30 of FIG. 1 of the Barrington U.S. Pat. No. 4,270,610. Also included in that test string is a tester valve 25 located below the combination safety-circulating valve 30 and a packer 27.

Such a test string including the apparatus 10 of the present invention is lowered into place within a well and the packer of the test string is set within the well bore just above the subsurface formation which is to be tested.

Hydrostatic well annulus pressures encountered in such a well may be on the order of 10,000 psi.

Assuming for example that the apparatus 10 is being utilized in a well for which the hydrostatic well annulus pressure at the depth of the apparatus 10 is 10,000 psi, the tester valve located therebelow will generally be designed to operate at a well annulus pressure of 1,500 psi above hydrostatic, that is a total well annulus pressure of 11,500 psi. The combination safety-circulating valve 10 of the present invention will typically be designed to operate at a well annulus pressure of 500 psi above that at which the tester valve operates, so the apparatus 10 of the present invention in such a context would be designed to operate at a well annulus pressure of 12,000 psi.

With the hydrostatically referenced first piston means 166 as utilized in the apparatus 10, the releasable retaining means 216 need only be designed to withstand the difference between hydrostatic well annulus pressure and the desired operating pressure of the apparatus 10. Thus in the example just given, the releasable retaining means 216 will need to be designed to withstand the difference between 12,000 psi and 10,000 psi, that is 2,000 psi.

Typically, the shear pins 222 of the releasable retaining means 216 are constructed so that each shear pin 222 can carry the load generated by a 500 psi pressure differential across the piston means 166. Thus, for the example just given, the releasable retaining means 216 would need to include a total of four shear pins 222 to give it an operating pressure of 2,000 psi above hydrostatic well annulus pressure.

With the design of the present invention, it is possible to achieve a consistency in operating pressure on the order of 10% so that when the apparatus 10 is designed to operate at a pressure of 2,000 psi above hydrostatic well annulus pressure, it will operate somewhere in the range of 1800 to 2200 psi very reliably.

Generally, the design operating pressure differential at which the apparatus 10 will be designed to operate is in the range from about 1500 psi to about 2500 psi above hydrostatic well annulus pressure.

With shear pins such as those mentioned wherein each pin can restrain approximately a 500 psi pressure differential, this means that no more than five shear pins 222 will have to be used in the releasable retaining means 216.

Thus, the number of shear pins utilized as compared to an apparatus like that shown in the Barrington U.S. Pat. No. 4,270,610 is greatly reduced thus substantially minimizing the inconsistencies in operating pressure of the tool.

Additionally, those shear pins 222 which are used are not subjected to any significant load as the apparatus 10 is lowered into a well, thus further increasing the consistency of the design operating pressure of the apparatus 10.

As the apparatus 10 is being lowered into a well, the slowly increasing hydrostatic well annulus pressure corresponding to the increasing depth of the apparatus 10 within the well can be metered through the pressurizing passage 290 of the metering cartridge 284 so that this increased well annulus pressure is substantially balanced across first piston means 166 so that no substantial loading is applied to the shear pins 222.

After the apparatus 10 has been lowered to the desired depth within a well, the packer located therebelow in the test string will be set to anchor the test string within the well bore and to seal the well annulus above the subsurface formation being tested.

Then, well annulus pressure will typically be increased by about 1500 psi above hydrostatic well annulus pressure one or more times to operate the tester valve located in the test string so that formation fluid may flow upwardly through the test string.

Each time well annulus pressure is rapidly increased to operate the tester valve, the sliding check valve member 312 will be forced upward to close the pressurizing passage 290 due to the resistance to fluid flow provided by the restricted area flow passage 332. Each time well annulus pressure is reduced back to hydrostatic pressure, the compression spring 340 will move the sliding check valve member 312 down to the open position shown in FIG. 2.

In a typical well testing program, the last time the tester valve is opened, it will be held in the open position by maintaining the increased well annulus pressure until such time as it is desired to close the safety valve means 82 and open the circulating valve means 84 of the apparatus 10.

During the time periods in which well annulus pressure has been increased to operate the tester valve, the increase in well annulus pressure of approximately 1500 psi creates a downward force on the first piston means 166, but the first piston means 166 is retained against movement by the releasable retaining means 216 which has been designed to require a higher pressure differential for operation.

When it is desired to operate the combination safety-circulating valve apparatus 10, well annulus pressure is further increased to the design operating pressure of 2,000 psi above hydrostatic well annulus pressure. This downward pressure differential of 2,000 psi across the first piston means 166 will shear the shear pins 222 of releasable retaining means 216 thus allowing the first piston means 166 to move downward relative to the housing 12.

As the first piston means 166 moves downward relative to the housing 12, the silicone oil in the upper portion 286 of second pressure conducting passage means 184 will be compressed to allow the volume decrease required to accommodate downward movement of the first piston means 166.

As the first piston means 166 moves downward, the upper end thereof will move out of engagement with the spring collet 234 thus allowing the spring fingers 236 thereof to be deflected radially inward.

That will release the second piston means 168 which at that time will have a very large upward pressure differential thereacross. The upward pressure differential across second piston means 168 will be the difference between the increased well annulus pressure, which in the example given above is 12,000 psi, and the substantially atmospheric pressure, that is substantially zero psi, in low pressure chamber 170.

This great pressure differential acting upwardly across second piston means 168 will move the second piston means 168 upward very rapidly.

As previously mentioned, upward movement of the second piston means 168 moves the ball valve 116 of safety valve means 82 upward relative to housing 12 thus rotating the ball valve 116 to a closed position closing the flow passage 124 through the housing 12.

Additionally, this upward movement of second piston means 168 causes the actuating mandrel 136 to impact the circulating valve sleeve 88 thus shearing the shear pins 110 holding the circulating valve sleeve 88 in its closed position. The spring 102 of circulating valve means 84 then aids in moving the circulating valve sleeve 88 upward to open the circulating port 96.

In the apparatus 10 shown in FIGS. 1A–1F, the ball valve 116 will close a very short time before the circulating valve 84 opens.

Thus, the apparatus 10 provides a combination safety-circulating valve which has eliminated the problem of inconsistent operating pressures by providing the first piston means 166 which is referenced to hydrostatic well annulus pressure thus greatly reducing the number of shear pins 222 which must be utilized to hold the apparatus 10 in its initial position until the desired time of operation.

Additionally, the pressure balancing feature provided for the first piston means 166 prevents the shear pins 222 from being substantially loaded as the apparatus 10 is being lowered into a well.

Furthermore, this has been accomplished without sacrificing the high pressure differential operation provided by an atmospheric reference power piston such as the second piston means 168.

It is important to have a high operating pressure differential on the second piston means 168 to provide as large a force as possible for closing the ball type safety valve 82 to assure that the safety valve 82 is closed completely and rapidly.

Additionally, by making the second piston means 168 referenced to atmospheric pressure and providing this large operating pressure differential thereacross, the force applied to close the ball valve 116 of safety valve means 82 is great enough that it can even close the ball valve 116 when a wireline has been run therethrough, thus shearing the wireline. This is important because it allows the ball valve 116 to be closed very rapidly when an emergency arises and there is not time to remove the wireline from the bore of the tool.

This rapid forceful closing is in contrast to devices such as that shown in U.S. Pat. Nos. 4,422,506 and 4,429,749 to Beck wherein a ball type tester valve is operated solely by a hydrostatic referenced annulus pressure responsive power piston. With tools of that type, there is sometimes a problem in that the tester valve may not completely close when well annulus pressure is suddenly bled off. This is because the pressure differential acting to reclose the tester valve will only be on the order of 1500 psi.

It is noted that both the safety valve means 82 and the circulating valve means 84 of the operating element means 86 of apparatus 10 are constructed so that they irreversibly move from their first positions as illustrated in FIGS. 1A–1C to their second positions previously described. That is, the safety valve means 82 and circulating valve means 84 cannot be returned to their first positions by further normal operation of the tool 10.

DESCRIPTION OF THE EMBODIMENT OF FIGS. 3A–3H

Referring now to FIGS. 3A–3H, a second embodiment of the present invention is shown and generally designated by the numeral 400.

The apparatus 400 includes a housing 402 made up of first and second longitudinally telescoping housing assemblies 404 and 406, respectively.

The first housing assembly 404 includes an upper adapter 403, a spring housing section 410, a ball valve housing section 412, an upper power housing section 414, a shear set housing section 416, a lower power housing section 418, an upper filler housing section 420, a liquid spring chamber housing section 422 including inner and outer tubular members 424 and 426, a lower filler housing section 428, and an equalizing chamber housing section 430.

The various sections 408–430 of the first housing assembly 404 are each threadedly connected together and provided with O-ring seals therebetween as illustrated.

The second housing assembly 406, beginning at its lower end, includes a lower adapter 432, an equalizing port housing section 434, a connector housing section 436 and a metering cartridge housing section 438.

The various sections 432–438 of the second housing assembly 406 are threadedly connected together and provided with suitable O-ring seals therebetween as illustrated.

The second housing assembly 406 has its upper portion slidably received within a lower portion of the first housing assembly 404.

Equalizing port housing section 434 of second housing assembly 406 includes a plurality of radially outward extending splines 440 which are meshed with a plurality of radially inwardly extending splines 442 of equalizing chamber housing section 430 of first housing assembly 404 to permit longitudinal telescoping motion and to prevent relative rotational motion between the first and second housing assemblies 404 and 406 of housing 402.

In FIGS. 3A–3H, the first and second housing assemblies 404 and 406 are shown in a telescopingly extended-most position defined by abutment of lower ends 444 of splines 440 with an upward facing annular shoulder 446 of equalizing chamber housing section 430.

Figure 3A:
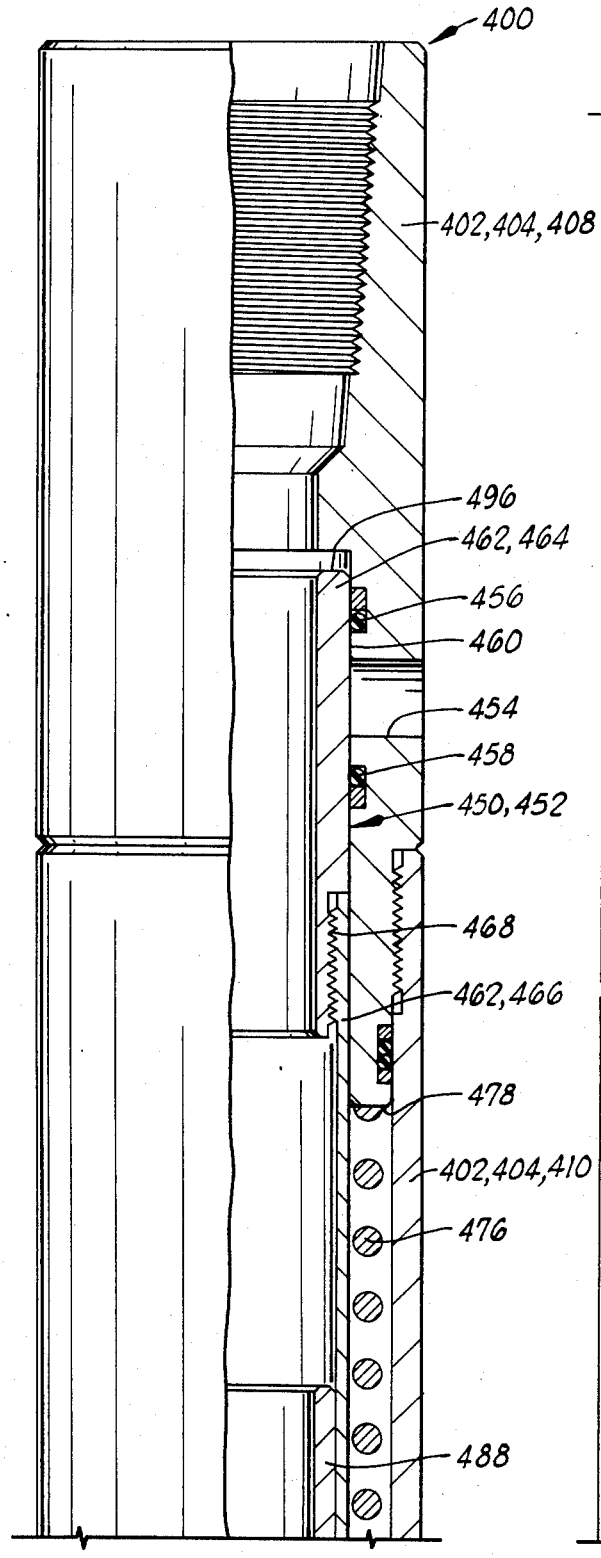
FIGS. 3A–3H comprise an elevation right-side only sectioned view of a second embodiment of the present invention.
Figure 3B:
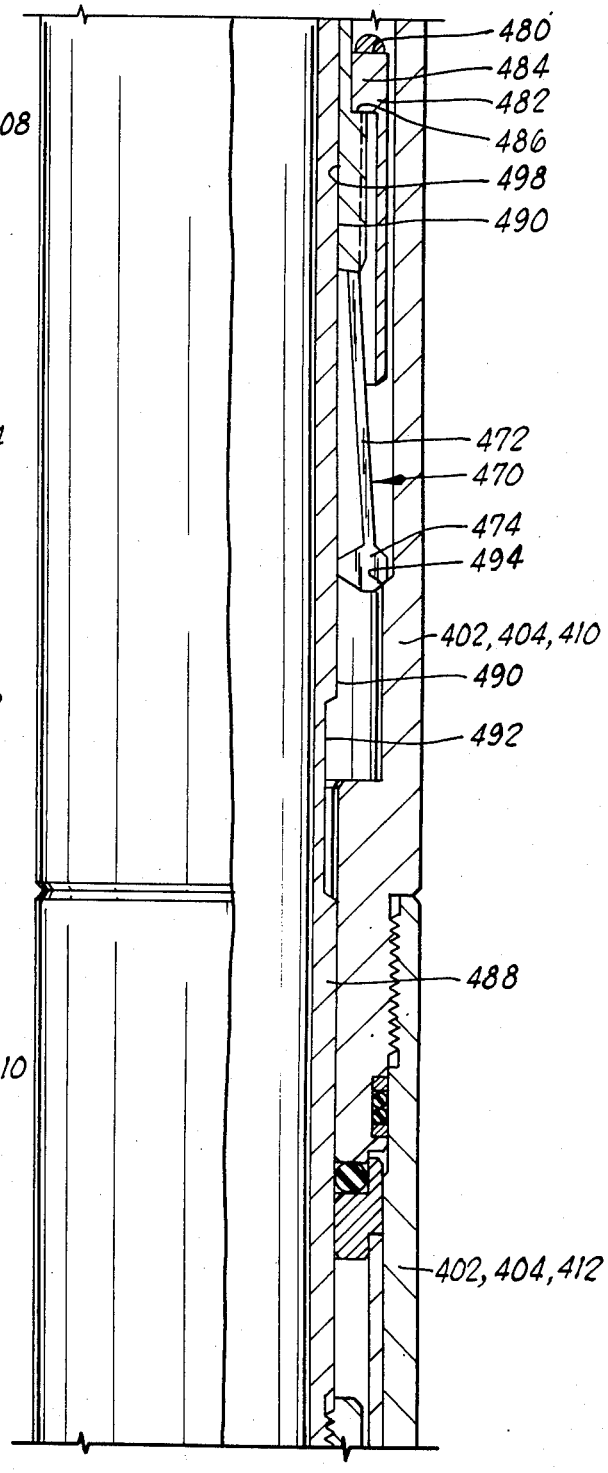
Figure 3C:
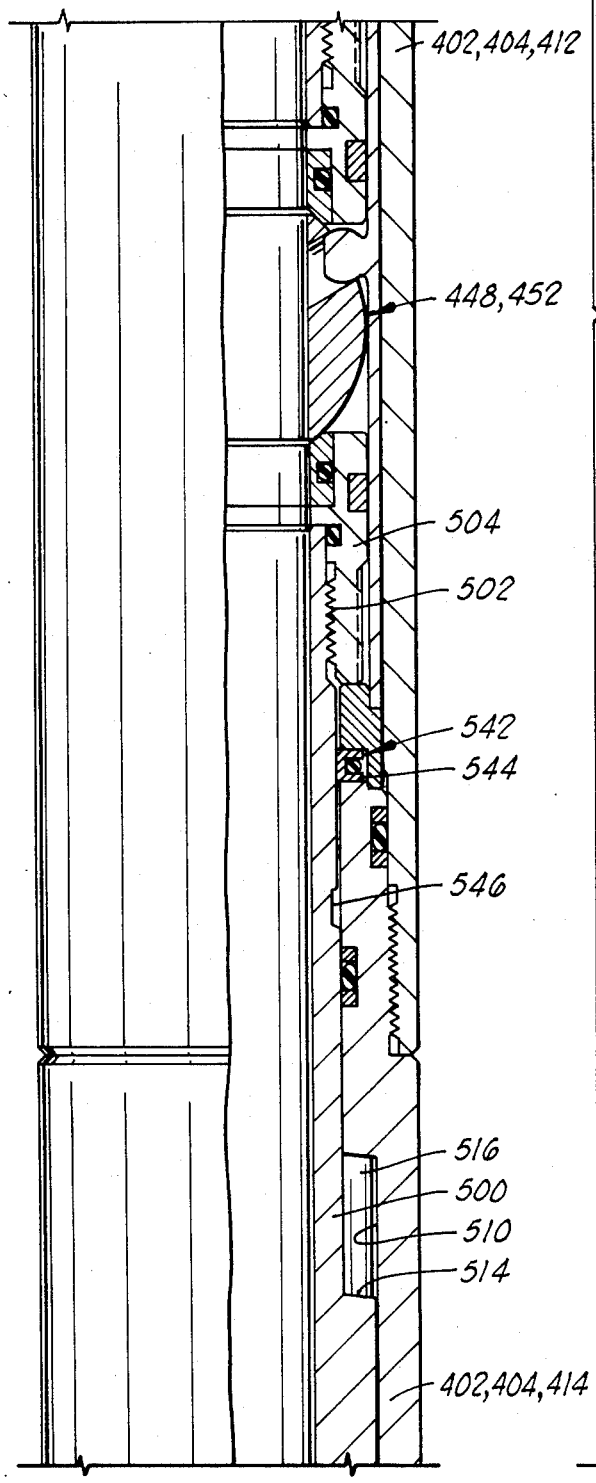
Figure 3D:
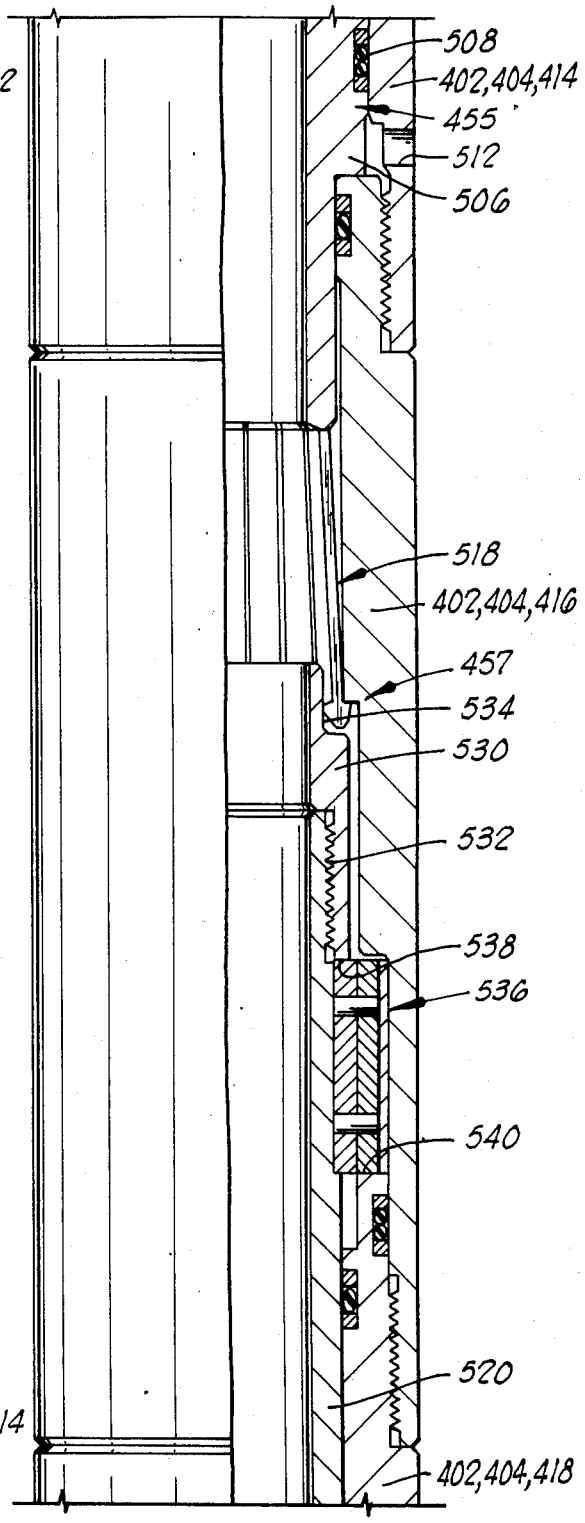
Figure 3E:
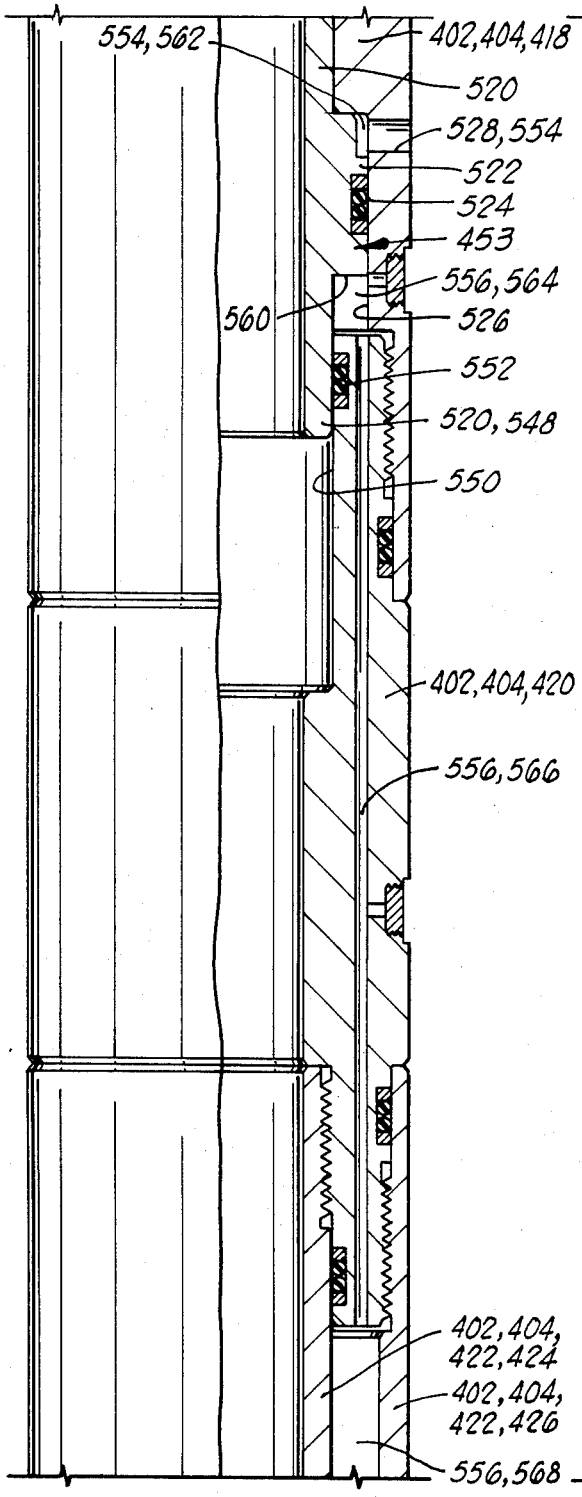
Figure 3F:
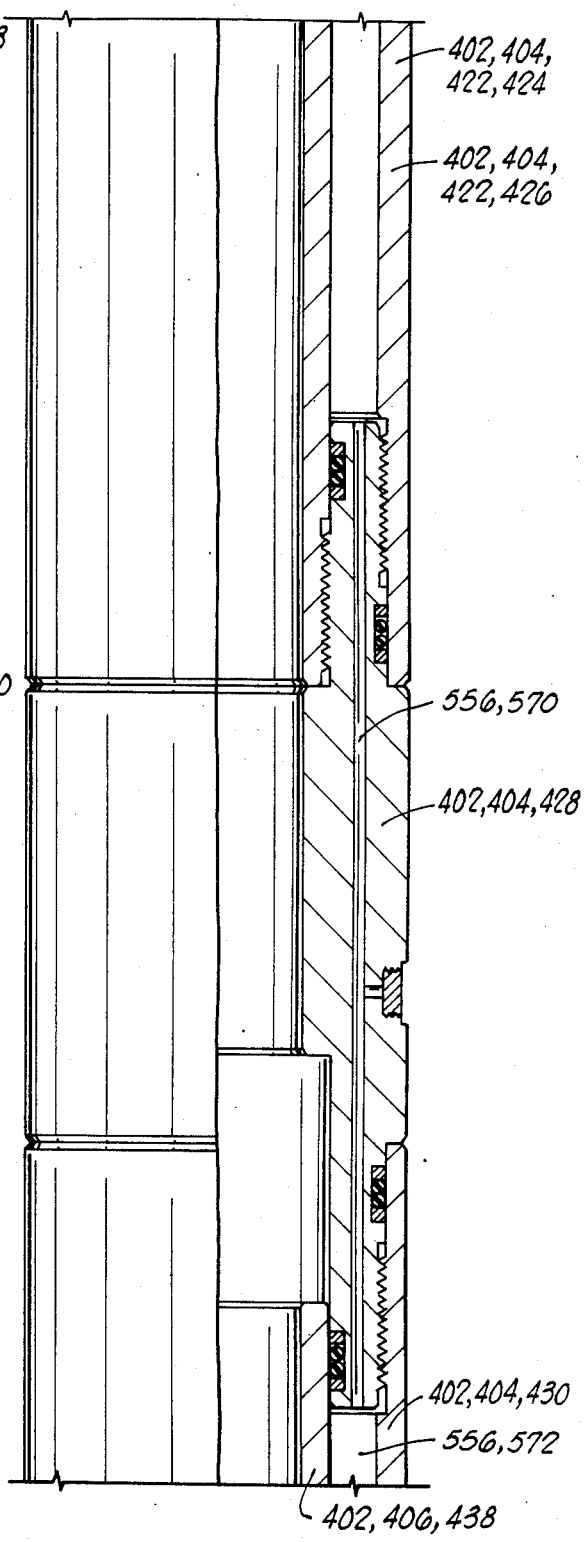

The apparatus 400 has a ball type safety valve means 448 disposed therein as shown in FIG. 3C, and a sliding sleeve type circulating valve means 450 disposed therein as shown in FIGS. 3A–3B. The safety valve means 448 and circulating valve means 450 may collectively be referred to as an operating element means 452 of the apparatus 400.

The details of construction of the safety valve means 448 are substantially identical to those of the safety valve means 82 of the apparatus 10 described above with reference to FIG. 1C and will not be repeated.

The apparatus 400 also includes a hydrostatically referenced annulus pressure responsive first piston means 453 and an atmospheric referenced annulus pressure responsive second power piston means 455 connected together by a prevention means 457 all of which operate in relation to each other in generally the same manner as indicated for the analogous components of the apparatus 10 of FIGS. 1A–1F. Any specific differences of significance are pointed out below.

The construction of the circulating valve means 450 of apparatus 400 is somewhat modified from that of the apparatus 10 shown in FIGS. 1A–1B.

The circulating valve means 450 includes a circulating port 454 disposed through the upper adapter 408. Upper adapter 408 carries upper and lower O-ring seals 456 and 458 for sealing against a cylindrical outer surface 460 of a circulating valve sleeve 462 when the circulating valve sleeve 462 is in a closed position as seen in FIGS. 3A–3B.

The circulating valve sleeve 462 includes an upper portion 464 and a lower portion 466 threadedly connected together at 468.

Integrally constructed at the lower end of lower portion 466 of circulating valve sleeve 462 is a spring collet 470 including a plurality of spring fingers 472 each of which includes an enlarged lug 474 on the lower free end thereof.

A coil compression spring biasing means 476 is disposed between a lower end 478 of upper adapter 408 and an upper end 480 of a spring retaining sleeve 482 which is received about lower portion 466 of circulating valve sleeve 462.

The spring retaining sleeve 482 includes a radially inward extending annular flange 484 which abuts an upward facing annular shoulder 486 of lower portion 466 of circulating valve sleeve 462.

Thus, the spring 476 biases the circulating valve sleeve 462 downward towards an open position further described below.

An actuating mandrel 488 is attached to the safety valve means 448 for longitudinal upward movement therewith relative to the housing 12.

The actuating mandrel 488 has a main cylindrical outer surface 490 and a reduced diameter cylindrical outer surface 492.

The housing 402, circulating valve sleeve 462, and actuating mandrel 488 are so arranged and constructed that when the second piston means 455 is in its first position as illustrated in FIGS. 3A–3D, the main cylindrical outer surface 490 of actuating mandrel 488 engages the lugs 474 of spring fingers 472 of spring collet 470 to hold the lugs 474 in a radially outward position wherein the lugs 474 are engaged with an upward facing annular tapered inner shoulder 494 of spring housing section 410 to initially hold the circulating valve sleeve 462 in its closed position.

When the second piston means 455 moves to its uppermost second position relative to the housing 402, the reduced diameter cylindrical outer surface 492 of actuating mandrel 488 is aligned with the lugs 474 of spring fingers 472 to allow the lugs 474 to deflect radially inward so that the spring 476 may move the circulating valve sleeve 462 downward to an open position wherein an upper end 496 of circulating valve sleeve 462 is located below circulating port 454.

An upper portion of the outer cylindrical surface 490 of actuating mandrel 488 is slidably received within a bore 498 of lower portion 466 of circulating valve sleeve 462.

The second piston means 455 includes a second power mandrel 500 connected at threaded connection 502 to the lower seat holder 504 of the safety valve means 448.

Second piston means 455 includes an enlarged diameter piston 506 defined thereon which carries a sliding piston seal 508 which seals against a bore 510 of upper power housing section 414.

A second power port 512 is disposed through upper power housing section 414 below the piston seal 508 of piston 506 for communicating well annulus pressure with the lower side of second power piston means 455.

An upper low pressure side 514 of second power piston means 455 is communicated with a sealed low pressure chamber 516 which generally contains air at substantially atmospheric pressure.

The lower end of second power mandrel 500 carries a spring collet 518 which comprises the prevention means 457 and is substantially similar to the spring collet 234 of prevention means 172 of the apparatus 10 of FIGS. 1A–1F.

The first power piston means 453 includes a first power mandrel 520 and an enlarged diameter piston 522 carrying a piston seal 524 which is slidably received in a bore 526 of lower power housing section 418.

A first power port 528 is disposed through lower power housing section 418 above the seal 524 of first piston means 453.

An upper extension 530 of first power mandrel 520 is threadedly connected thereto at threaded connection 532. The upper extension 530 of first power mandrel 520 has defined thereon a cylindrical outer surface 534 which is analogous to the cylindrical outer surface 240 seen in FIG. 1D, and which cooperates with the spring collet 518 so as to release the spring collet 518 when the first power mandrel 520 is moved downward relative to housing 402.

A shear set type releasable retaining means 536 analogous to the releasable retaining means 216 of FIG. 1D is located between a lower end 538 of upper extension 530 and an upper end 540 of lower power housing section 418.

A locking means 542 analogous to the locking means 276 of FIG. 1C operates to lock the second power mandrel 500 in an uppermost second position wherein locking dogs 544 are received within an annular groove 546 of second power mandrel 500.

A lower portion 548 of first power mandrel 530 is slidably received within a bore 550 of upper filler housing section 420 with a seal being provided therebetween by O-ring 552.

The lower portions of the apparatus 400 seen in FIGS. 3E–3H are considerably different from the lower portions of the apparatus 10 of FIGS. 1A–1F and now will be described in further detail.

The housing 402 can generally be described as having first and second pressure conducting passage means disposed therein for communicating a well annulus exterior of the housing 402 with a first upper high pressure side 558 and a second lower low pressure side 560 of first power piston means 453, in a manner analogous to the first and second pressure conducting passage means 182 and 184 of the apparatus 10 of FIGS. 1A–1F.

The first pressure connecting passage means 554 includes the first power port 528 and an annular space 562 defined between first power piston means 453 and bore 526 above piston seal 524.

The second pressure conducting passage means 556 includes an annular space 564 between first power mandrel 520 and bore 526 below piston seal 524, a plurality of longitudinal bores 566 disposed through upper filler housing section 420, an annular liquid spring chamber 568 defined between inner and outer tubular members 424 and 426 of liquid spring chamber housing section 422, a plurality of longitudinal ports 570 disposed through lower filler housing section 428, an annular space 572 defined between metering cartridge housing section 438 and equalizing chamber housing section 430, a pressurizing passage 574 defined through an enlarged diameter metering cartridge portion 576 of metering cartridge housing section 438, an equalizing chamber 578 between connector housing section 436 and equalizing chamber housing section 430, and a plurality of longitudinal equalizing ports 580 disposed through equalizing port housing section 434. The longitudinal equalizing ports 580 terminate in an annular groove 581 of equalizing port housing section 434.

The equalizing chamber 578 includes a floating piston 602 therein having inner and outer seals 604 and 606 for separating silicone oil located thereabove from well fluid located therebelow.

Figure 3G:
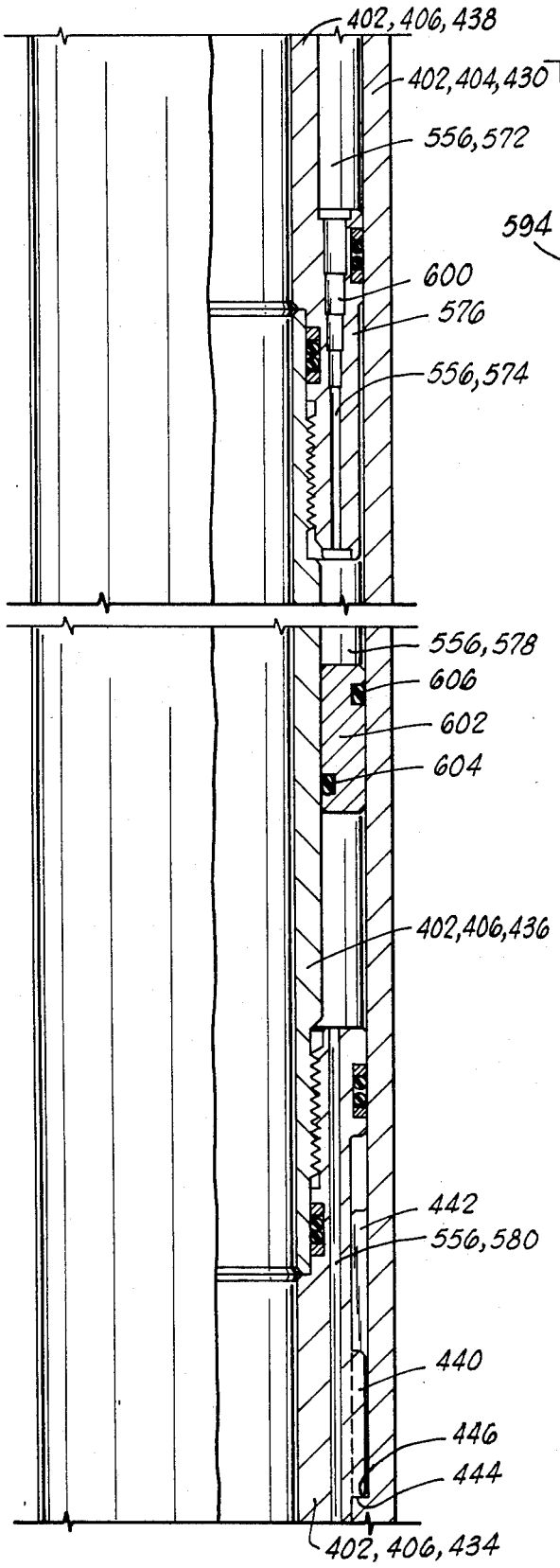
Figure 3H:
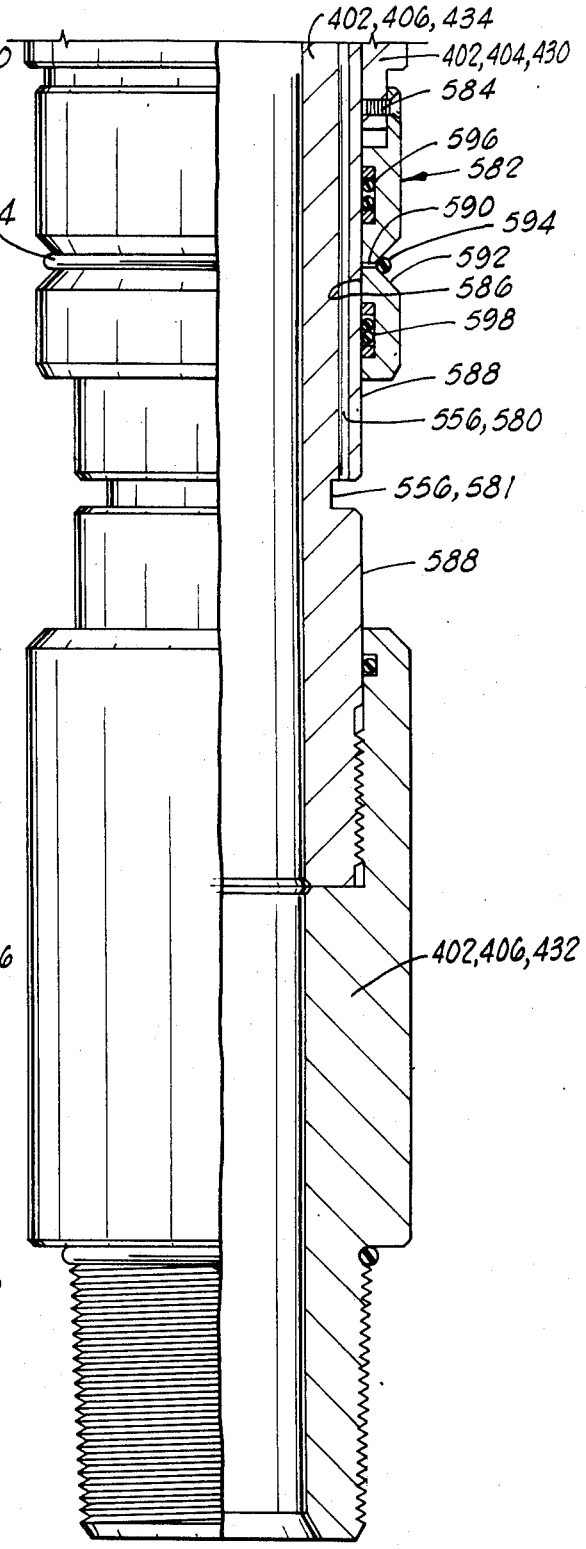

The apparatus 400 includes a selectively actuatable one-way check valve means 582 seen in FIG. 3H which is connected to the lower end of equalizing chamber housing section 430 by screws 584.

The check valve means 582 is a cylindrical device having an inner bore 586 closely and slidably received about a cylindrical external surface 588 of equalizing port housing section 434.

Check valve means 582 includes a plurality of radial ports 590 which communicate the inner bore 586 with a V-shaped radially outer groove 592 of check valve means 582.

A resilient annular sealing band 594 is received about the V-shaped groove 592 in such a manner that it normally closes the outer ends of the radial ports 590.

Check valve means 582 carries upper and lower O-ring seals 596 and 598 which seal against the outer surface 588 of equalizing port housing section 434.

When first housing assembly 404 moves downward relative to second housing assembly 406 in a manner further described below, the check valve means 582 is moved downward until its radial ports 590 communicate with the annular outer groove 581 of equalizing port housing section 434 with the seals 596 and 598 sealing against the outer surface 588 above and below the groove 581, respectively.

When the check valve means 582 has been moved downward in the manner just described, it may be said to be in a selectively actuated position in which the resilient sealing band 594 will prevent any increase in well annulus pressure from being transmitted through the second pressure conducting passage means 556 to the second low pressure side 560 of first piston means 453 so that an increase in well annulus pressure will create a downward pressure differential across a first piston means 453.

The relative telescoping motion between the first and second housing assemblies 404 and 406 is controlled by the metering cartridge section 576 seen in FIG. 3G.

The pressurizing passage 574 disposed through metering cartridge section 576 has a reduced diameter fluid flow restricting orifice means 600 schematically shown in FIG. 3G which impedes relative longitudinal movement between the first and second housing assemblies 404 and 406 due to the time required to meter fluid contained in the annular space 572 and the equalizing chamber 578 therethrough.

The purpose of the metering cartridge section 576 is to maintain the first and second housing assemblies 404 and 406 in their relatively extended position as seen in FIGS. 3A–3H as the apparatus 400 is being run into a well.

OPERATION OF THE EMBODIMENT OF FIGS. 3A–3H

The apparatus 400 of FIGS. 3A–3H is made up in a well test string like that shown in FIG. 1 of U.S. Pat. No. 4,270,610 to Barrington previously discussed. The apparatus 400 is initially in the position illustrated in FIGS. 3A–3H.

As the apparatus 400 is run into the well with the test string, the relatively slow increases in well annulus pressure will be metered through the flow restrictor 600 of metering cartridge 576 at a sufficiently fast rate to prevent any significant downward pressure differential from being applied across first piston means 453. Thus, pressures across first piston means 453 are substantially balanced as the apparatus 400 is run into a well, and no significant load is placed upon the shear pins of the shear set 536 seen in FIG. 3D.

The metering cartridge section 576 also serves to prevent the first housing assembly 404 from moving downward over the second housing assembly 406 due to compressional loads of short duration encountered as the test string is lowered through the well. This again is due to the time delay provided by the flow restrictor 600.

After the apparatus 400 is lowered to the desired location within a well, a packer located therebelow in the test string is set.

Then, weight is set down on the test string in order to move the first housing assembly 404 downward over the second housing assembly 406 so that the grooves 581 is located between seals 596 and 598 thus placing the check valve 582 over the open lower end of second pressure conducting passage means 556 defined by the groove 581. This traps hydrostatic well annulus pressure below first piston 453 and thereafter, no subsequent well annulus pressure increase can be transferred to the second low pressure side 560 of first piston means 453.

Then, well annulus pressure will be increased to an intermediate level to operate a tester valve located in the test string. During operation of the tester valve, the releasable retaining means 536 will prevent operation of the apparatus 400.

Then upon increase of well annulus pressure to an appropriate operating pressure to shear the shear pins of shear set 536, the first piston means 453 will move downward releasing the spring collet 518 and thus allowing the second power piston means 455 to be moved upward thus closing the ball valve of safety valve means 448 and moving the actuating mandrel 488 to a position which releases the spring collet 472 of circulating valve 450.

Then, the spring 476 of circulating valve 450 may move the circulating valve sleeve 462 downward to uncover the circulating port 454.

DESCRIPTION OF THE EMBODIMENT OF FIGS. 4A–4I

Referring now to FIGS. 4A–4I, a third embodiment of the combination safety-circulating valve of the present invention is shown and generally designated by the numeral 650.

The apparatus 650 includes a housing 652 which includes an upper adapter 654, a spring housing section 656, a ball valve housing section 658, an upper power housing section 660, a shear set housing section 662, a shear nipple housing section 664, a lower power housing section 666, a nitrogen filler nipple housing section 668, a nitrogen chamber housing section 670 having inner and outer tubular members 671 and 673, a lower filler nipple housing section 672, an equalizing chamber housing section 674, and a lower adapter 676.

Housing 652 also includes an upper inner mandrel housing section 678, a metering cartridge housing section 680, and an inner equalizing chamber mandrel housing section 682.

Figure 4A:
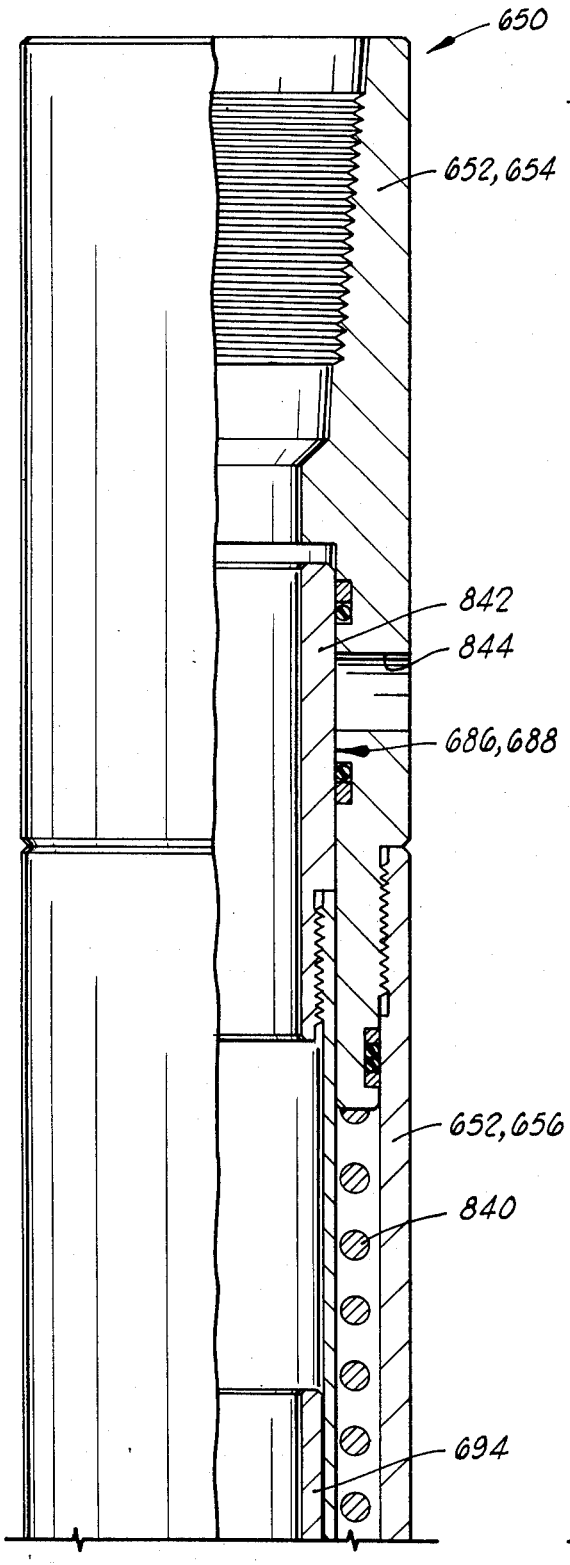
Figure 4B:
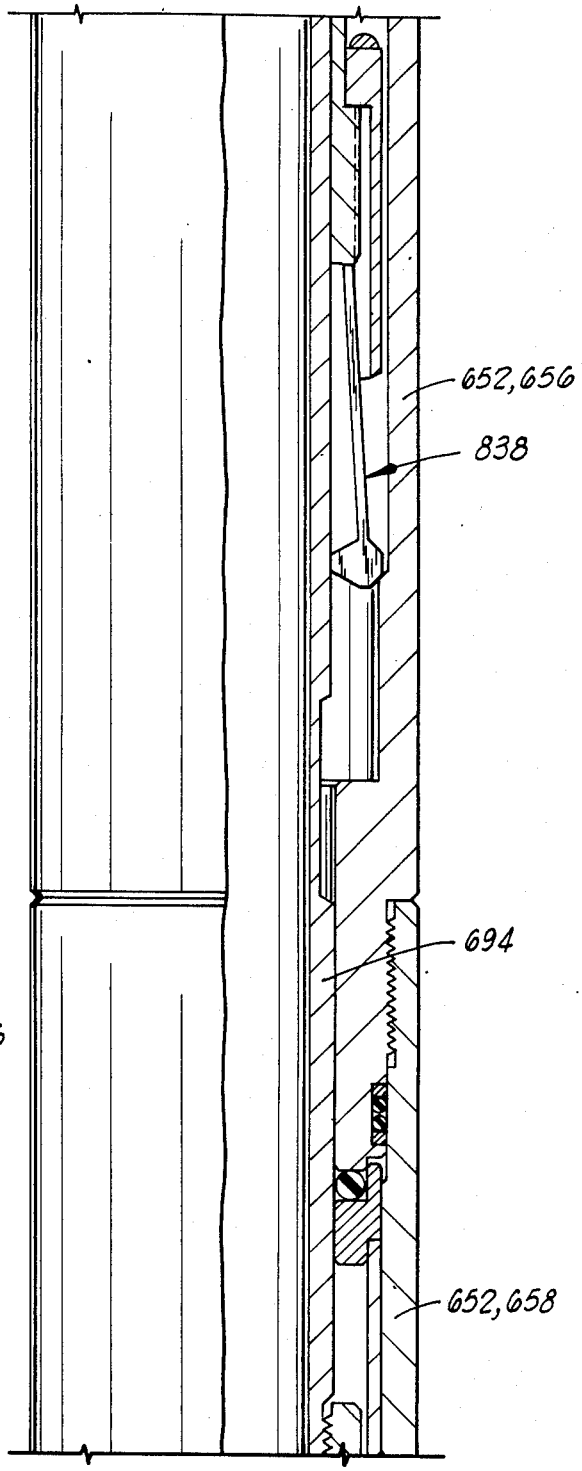
Figure 4C:
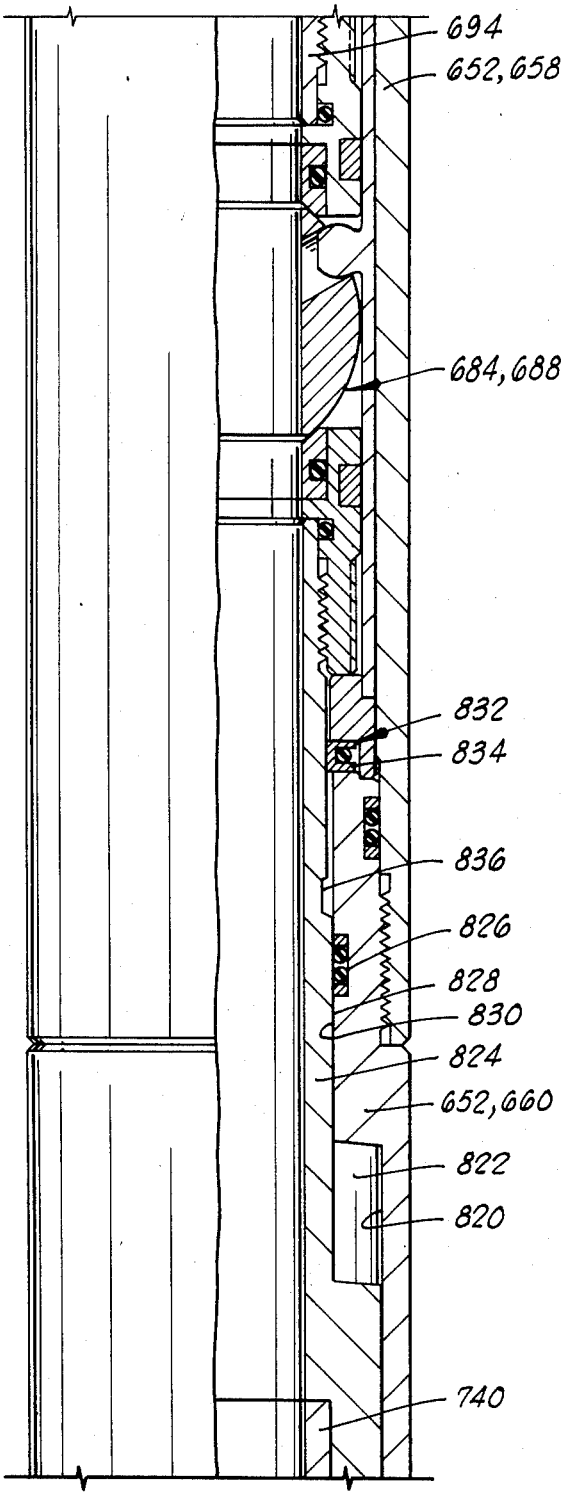

The apparatus 650 includes a rotatable full opening ball type safety valve means 684 seen in FIG. 4C, and a sliding sleeve type circulating valve means 686 seen in FIGS. 4A–4B which may be jointly referred to as an operating element means 688.

The safety valve means 684 of FIG. 4C is substantially similar to the safety valve means 82 of FIG. 1C.

The circulating valve means 686 of FIGS. 4A–4B is substantially similar to the circulating valve means 450 of FIGS. 3A–3B.

An actuating mandrel 694 extending upward from safety valve means 684 is constructed and functions in a substantially identical manner to the actuating mandrel 488 of the apparatus 400 of FIGS. 3A–3H.

The apparatus 650 includes a hydrostatically referenced annulus pressure responsive first power piston means 690, and an atmospheric referenced annulus pressure responsive second power piston means 692 which generally function in a manner similar to the first and second piston means 166 and 168 of the apparatus 10 of FIGS. 1A–1F, but which are operationally connected together in a very different manner as further described below.

In the apparatus 650, the manner of balancing hydrostatic well annulus pressure across the first piston means 690 is considerably different from that shown in either of the two embodiments previously described. It is, however, very similar to the manner utilized in U.S. Pat. No. 4,422,506 to Beck with regard to the power piston 252 shown in FIG. 2C thereof.

The first power piston means 690 includes a first power mandrel 696 having an enlarged diameter piston 698 defined thereon which carries a piston seal 700 which sealingly engages a bore 702 of lower power housing section 666.

A lower end of first power mandrel 696 has a cylindrical outer surface 704 which is slidably received within a bore 706 of nitrogen filler nipple housing section 668 with upper and lower sliding seals being provided therebetween by O-ring means 708 and 710.

A transverse port 712 communicates an inner annular groove 714 of nitrogen filler nipple housing section 668 with an exterior of the housing 652 to prevent hydraulic binding of the first power mandrel 696.

First piston means 690 includes an intermediate extension 716 of first power mandrel 696 which is threadedly connected thereto at threaded connection 718 with a seal being provided therebetween by O-ring 720.

Intermediate extension 716 includes a plurality of radially outward extending splines 722 which mesh with a plurality of radially inward extending splines 724 of shear nipple housing section 644 to allow relative longitudinal movement but prevent relative rotational movement between the first piston means 690 and the housing 652.

Figure 4D:
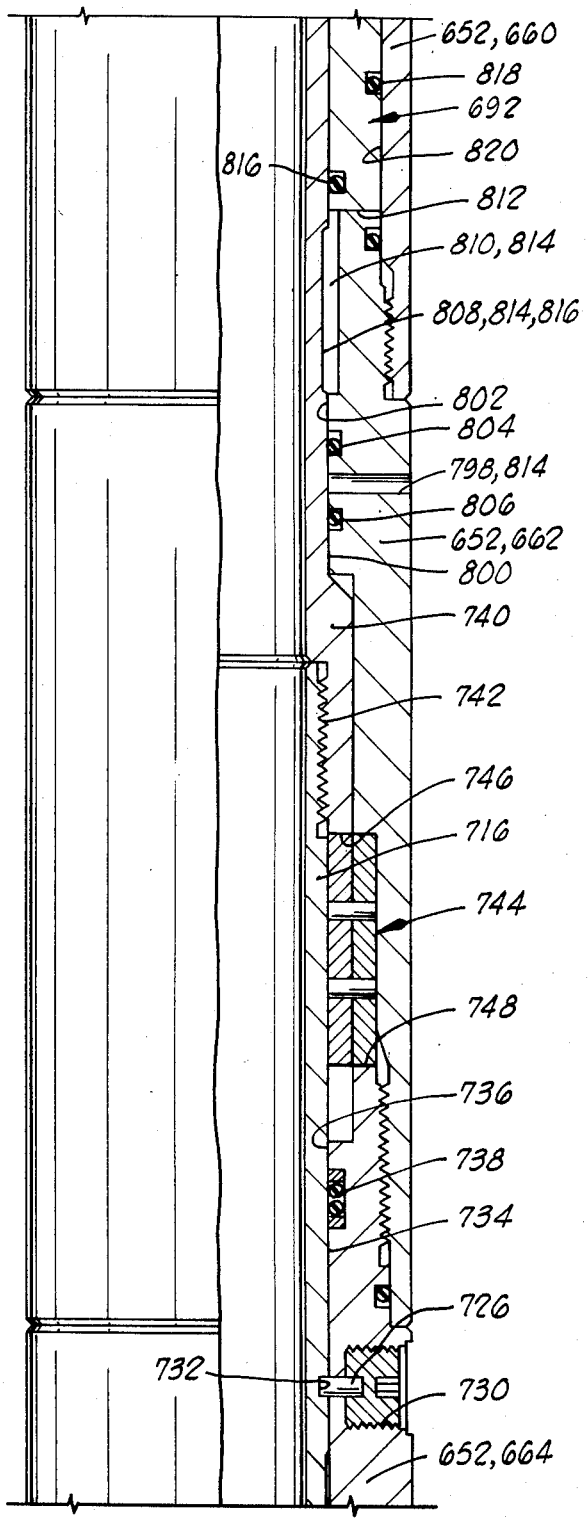
Figure 4E:
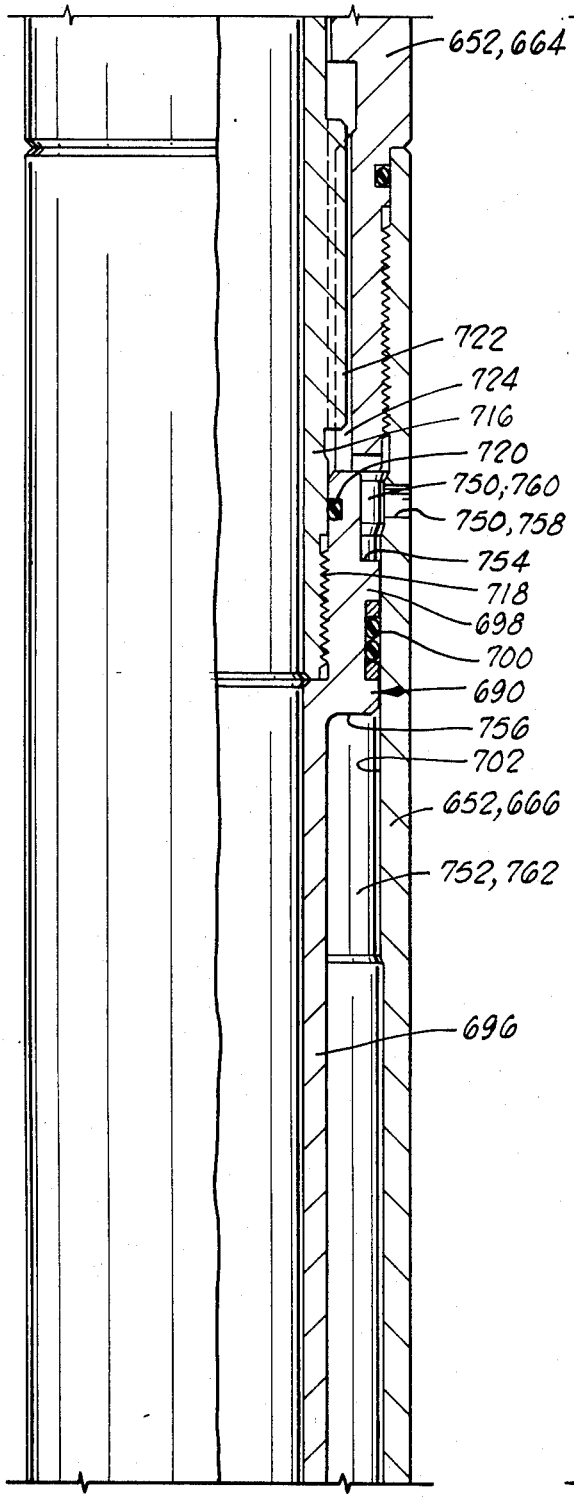
Figure 4F:
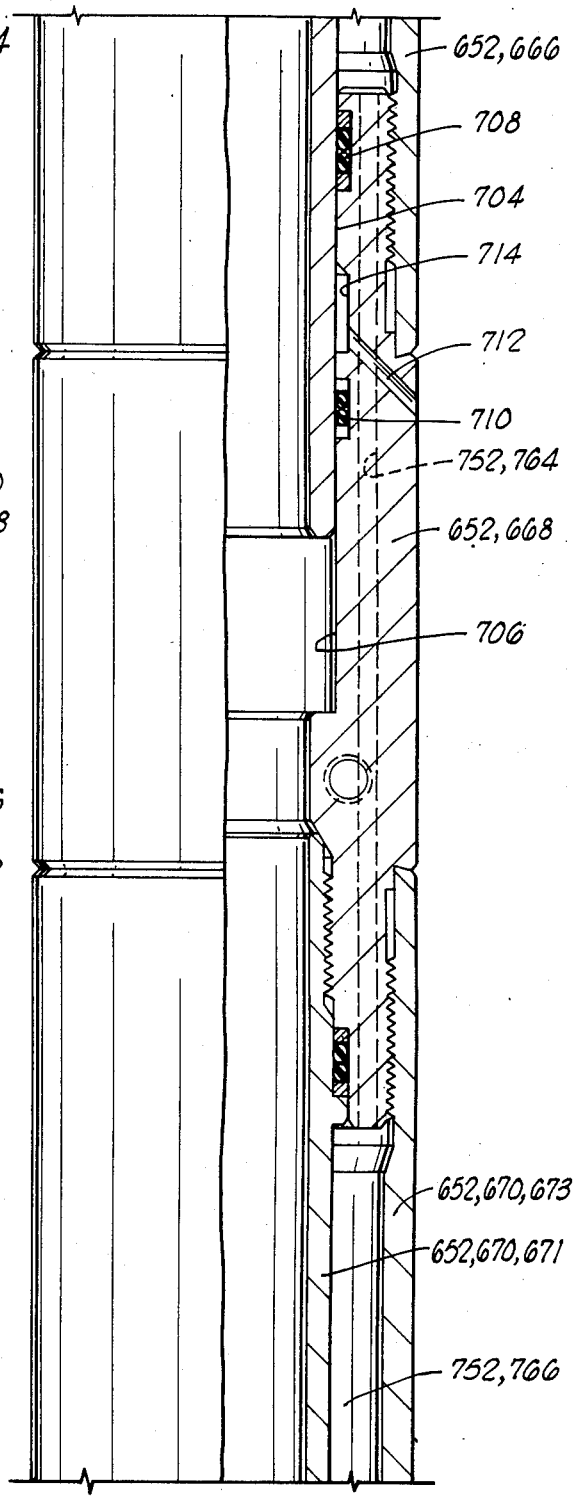
Figure 4G:
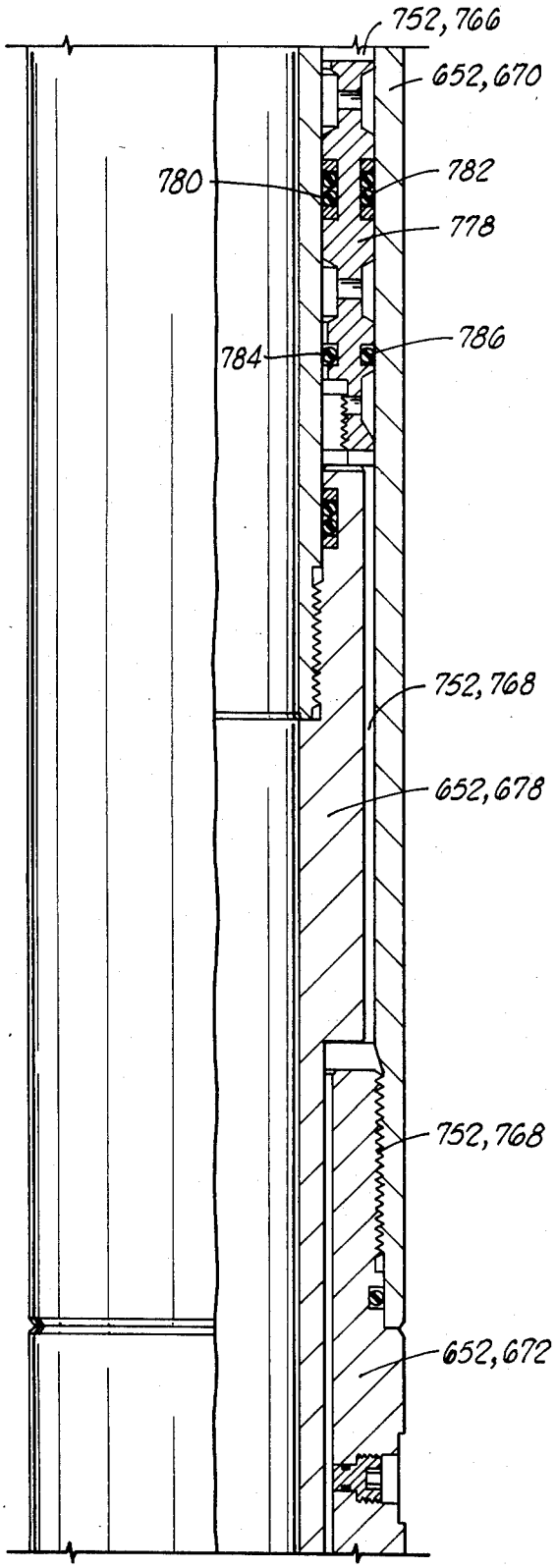
Figure 4H:
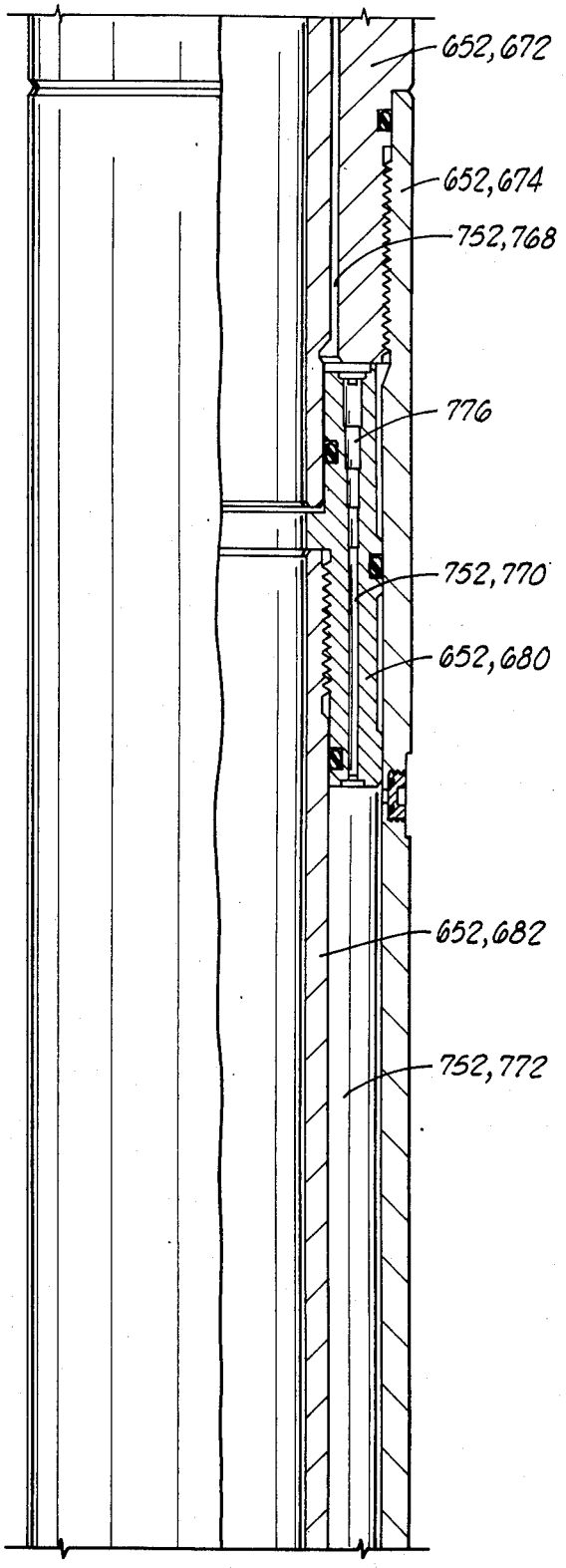
Figure 41:
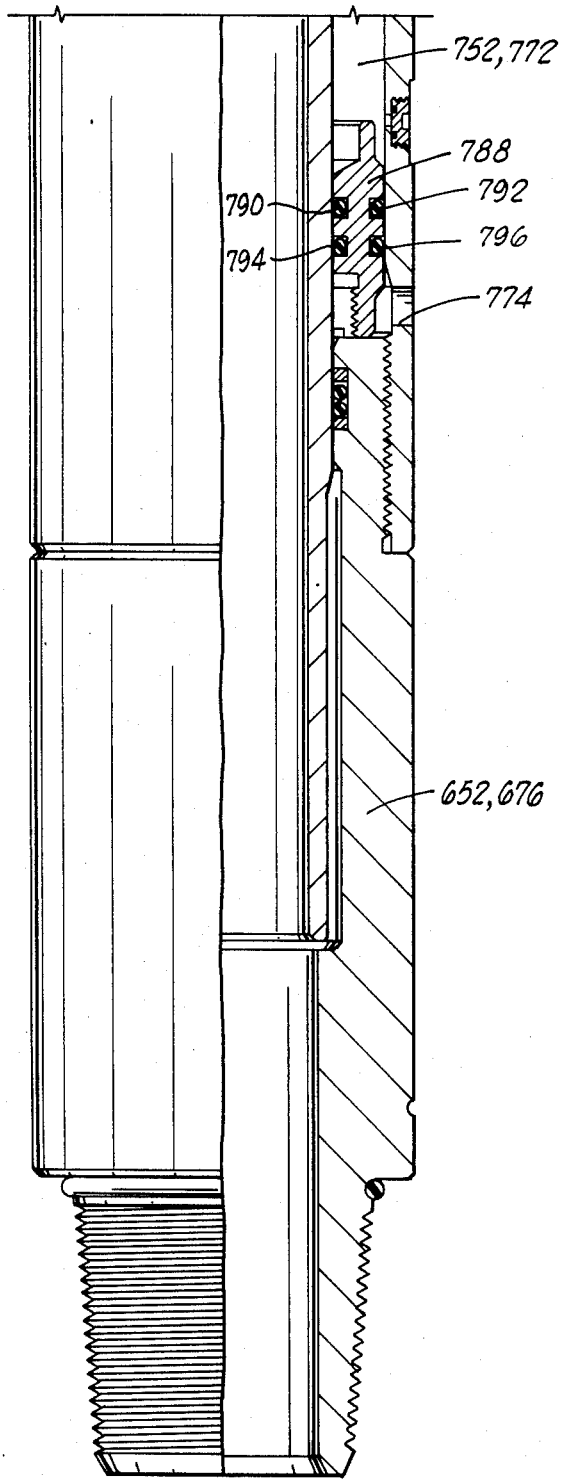

One or more individual shear pins 726 received in individual shear pin holders 728 threadedly connected to threaded radially bores 730 of shear nipple housing section 664 are received in a radially outer annular groove 732 of intermediate extension 716 to aid in initially holding the first piston means 690 in its uppermost first position as seen in FIGS. 4D–4E.

A cylindrical outer surface 734 of intermediate extension 716 is closely received within a bore 736 of shear nipple housing section 664 with a seal being provided therebetween by O-ring means 738.

An upper extension 749 of first power mandrel 696 is connected to intermediate extension 716 at threaded connection 742.

A shear set type releasable retaining means 744 analogous to the shear set releasable retaining means 216 of FIG. 1D is located between a lower end 746 of upper extension 740 and an upper end 748 of shear nipple housing section 664.

It will be appreciated that the shear set releasable retaining means 744 and the individual shear pins 726 combined together determined the operating pressure at which the first piston means 690 will move downward relative to housing 652.

The housing 652 may generally be described as including first and second pressure conducting passage means 750 and 752, respectively, for communicating a well annulus exterior of the housing 652 with an upper first side 754 and a lower second side 756, respectively, of the first power piston means 690. The first and second pressure conducting passage means 750 and 752 of the apparatus 680 are analogous to the first and second conducting passage means 182 and 184 of the apparatus 10 of FIGS. 1A–1F.

The first pressure conducting passage means 750 includes a first power port 758 disposed through lower power housing section 666.

First pressure conducting passage means 750 also includes an annular space 760 defined between the power piston 698 and lower power housing section 666 above the piston seal 700.

The second pressure conducting passage means 752 includes an annular space 762 between first power mandrel 696 and lower power housing section 666, a plurality of longitudinally extending ports 764 through nitrogen filler nipple housing section 668, an annular nitrogen chamber 766 between inner and outer tubular members 671 and 673 of nitrogen chamber housing section 670, an irregular annular space 768 between upper inner mandrel housing section 652 on the inside and nitrogen chamber housing section 670 and lower filler nipple housing section 672 on the outside, a pressurizing passage 770 through metering cartridge 680, and an annular equalizing chamber 772 between equalizing chamber mandrel housing section 682 and equalizing chamber housing section 674. The lower end of equalizing chamber 772 is communicated with the well annulus through an equalizing port 774 disposed through equalizing chamber housing section 674.

The pressurizing passage 770 of metering cartridge housing section 680 includes a flow restrictor schematically indicated by the numeral 776 having a restricted area orifice or flow passage disposed therethrough.

An upper floating piston 778 is disposed in nitrogen chamber 766 and includes upper inner and outer seals 780 and 782 and lower inner and outer seals 784 and 786.

A lower floating piston 788 is received in equalizing chamber 772 and includes upper inner and outer seals 790 and 792 and lower inner and outer seals 794 and 796.

An upper portion of second fluid conducting passage means 752 between the lower side 756 of first piston means 690 and the upper floating piston 778 is filled with a pressurized inert gas which is typically nitrogen gas.

Those portions of the second pressure conducting passage means 752 between the upper floating piston 778 and the lower floating piston 788 are filled with a suitable liquid for metering through the metering cartridge 680, which liquid may be a hydraulic oil or may be silicone oil.

The lower shoe 788 separates the oil located thereabove from well fluid which enters through the equalizing port 774 therebelow.

The metering cartridge 680 will generally also include a depressurizing passage (not shown) and may include several variations of arrangements of fluid flow restrictors, check valves and pressure relief valves in the pressurizing passage 770 and the depressurizing passage so that if desired a portion of an increase in well annulus pressure can be trapped above the metering cartridge, and in any event so as to provide a time delay in the transmission of both increases and decreases in well annulus pressure to the lower side of the power piston. A similar arrangement is seen in FIG. 2I of U.S. Pat. No. 4,444,268 to Barrington, the details of which are incorporated herein by reference.

The first power piston 690 and the associated metering cartridge 680 operate together so that as the apparatus 650 is lowered into a well, the relatively slow increases in well annulus hydrostatic pressure are metered through the fluid flow restrictor 776 in the pressurizing passage 770 to substantially balance this slowly increasing well annulus pressure across the first power piston 690.

A relatively rapid increase in well annulus pressure, however, cannot be transmitted quickly through the pressurizing passage 770, and thus the relatively rapid increase in well annulus pressure will create a downward pressure differential across the first piston means 690. Such a downward pressure differential of sufficient magnitude will shear the shear pins of shear set 744 and the individual shear pins 726 thus allowing the first piston means 690 to move downward compressing the pressurized nitrogen gas contained in annular space 762 and nitrogen chamber 766.

After the passage of a sufficient period of time, the entire increase in well annulus pressure will be metered through the pressurizing passage 770. Of course, if the pressurizing passage 770 includes a pressure relief valve something less than the entire pressure increase may ultimately be metered through the pressurizing passage 770.

Turning now to the manner of operation of the second power piston means 692, a second power port 798 is disposed through shear set housing section 662.

The upper power mandrel extension 740 of first power piston means 690 has a main cylindrical outer surface 800 defined thereon which is initially closely received within a bore 802 of shear set housing section 662 with upper and lower O-ring seals 804 and 806 sealing therebetween above and below the second power port 798.

Upper extension 740 has a reduced diameter cylindrical outer surface 808 located above main cylindrical outer surface 800.

When the first power piston means 690 moves downward pulling the upper power mandrel extension 740 downward, the reduced diameter surface 808 will move to a position adjacent second power port 798 so as to communicate the second power port 798 with an annular space 810 defined between upper extension 740 and shear set housing section 662, which annular space is communicated with a lower end 812 of second piston means 692.

The second power port 798, the reduced diameter surface 808, and the annular space 810 can be collectively described as defining a second power passage 814 disposed through the housing 652 for communicating the well annulus exterior of the housing 652 with a high pressure second lower side 812 of second power piston means 692.

The seal 804 can generally be described as a prevention means 804 operatively associated with the upper extension 740 of first piston means 690 and with the housing 652 for closing the second power passage 814 and isolating the lower high pressure side 812 of second piston means 692 from the well annulus when the first piston 690 is in its first position as illustrated in FIGS. 4A–4I.

It is noted that the first pressure conducting passage 750 associated with first piston means 690 can be described as a first power passage 750 disposed through the housing 652 for constantly communicating the well annulus with the upper high pressure side 754 of the first piston means 690. The first power passage 750 is isolated from the second power passage 814 within the housing 652.

The reduced diameter surface 808 of upper extension 740 can be generally described as a bypass passage of the upper power mandrel extension 740 for allowing well annulus fluid to bypass the seal means 804 so that the lower high pressure side 812 of second piston means 692 is communicated with the well annulus when the first piston means 690 moves downward to its second position.

The upper extension 740 and the upper power housing section 660 define an annular space therebetween within which the second power piston 692 is received. The second power piston 692 includes inner and outer annular seals 816 and 818 for providing a sliding seal between the second piston means 692 and the outer surface of upper extension 740 on the inside and a bore 820 of upper power housing section 660 on the outside.

A lower pressure chamber 822 is defined between an upper second power mandrel 824 of second piston means 692 and the inner bore 820 of upper power housing section 660.

An O-ring seal means 826 seals between an outer surface 828 of second power mandrel 824 and a bore 830 of upper power housing section 660.

A locking means 832 analogous to the locking means 276 of FIG. 1C will lock the second power piston 692 in its uppermost second position when locking dogs 834 are received in a groove 836.

OPERATION OF THE EMBODIMENT OF FIGS. 4A–4I

The apparatus 650 of FIGS. 4A–4I will be assembled with a test string like that shown in FIG. 1 of U.S. Pat. No. 4,270,610 to Barrington et al., and then lowered into a well.

As the apparatus 650 is lowered into the well, increasing hydrostatic well annulus pressure will be balanced across the first piston means 690 as it is metered through the flow restrictor 776 of metering cartridge 680.

After being lowered to a desired depth, a packer located therebelow in the test string will be set, and well annulus pressure will be rapidly increased to open a tester valve of the test string. Subsequently, well annulus pressure may be rapidly decreased to close the tester valve of the test string. During operation of the tester valve, the releasable retaining means 744 and shear pins 726 will prevent operation of the apparatus 650.

When it is desired to operate the apparatus 650, well annulus pressure must first be returned to hydrostatic pressure and held there for a sufficient time that the metering cartridge 680 can return pressure in nitrogen chamber 766 to hydrostatic well annulus pressure.

Then to operate apparatus 650, well annulus pressure will be rapidly increased to create a downward pressure differential on first piston means 690 sufficient to shear the shear pin set 744 and the individual shear pins 726, which again will preferably be at a pressure of approximately 2,000 psi above hydrostatic well annulus pressure.

When the first power piston means 690 moves downward, the reduced diameter surface 808 of upper power mandrel extension 740 will communicate the second power port 798 with the lower end 812 of second power piston means 692 thus exposing the second power piston means 692 to a large upward pressure differential as defined between the well annulus and the sealed low pressure chamber 822.

This pressure differential will move the second power piston 692 upward relative to housing 652 thus closing the safety valve 684, and releasing a spring collet 838 of circulating valve 686 and allowing coil compression spring 840 of circulating valve 686 to move a circulating valve sleeve 842 downward to uncover circulating port 844.

One advantage of the embodiment of FIGS. 4A–4I with regard to the difference in its metering cartridge 680 is that the metering cartridge 680 will allow the pressure between the first power piston 690 and the metering cartridge 680 to be continuously maintained at substantially well annulus hydrostatic pressure during any fluctuations in temperature which might occur during operation of the tool 650. This is contrasted to the embodiments of FIGS. 1A–1F and 3A–3H wherein the well annulus hydrostatic pressure is trapped by a check valve and subsequent temperature fluctuations in the operating environment of the tool could cause the trapped reference pressure to vary from hydrostatic well annulus pressure.

As is apparent from the several types of metering systems disclosed for the various embodiments shown in the pressure application, the well annulus hydrostatic pressure referenced first power piston can operate based upon a trapped well annulus hydrostatic referenced pressure such as shown in the embodiments of FIGS. 1A–1F and 3A–3H, or based upon a hydrostatic well annulus pressure that can vary with temperature fluctuations such as shown in the embodiments of FIGS. 4A–4I.

DESCRIPTION OF THE EMBODIMENTS OF FIGS. 5A–5D

Referring now to FIGS. 5A–5F, an upper portion of a fourth embodiment of the present invention is shown and generally designated by the numeral 900. The lower portions of the apparatus 900 are identical to FIGS. 4E–4I, and thus have not been repeated.

The apparatus 900 includes a housing 902 having an upper adapter 904, a ball valve housing section 906, an upper power housing section 908, a shear set housing section 910, and lower sections identical to those shown in FIGS. 4E–4I for the housing 652 thereof.

Figure 5A:
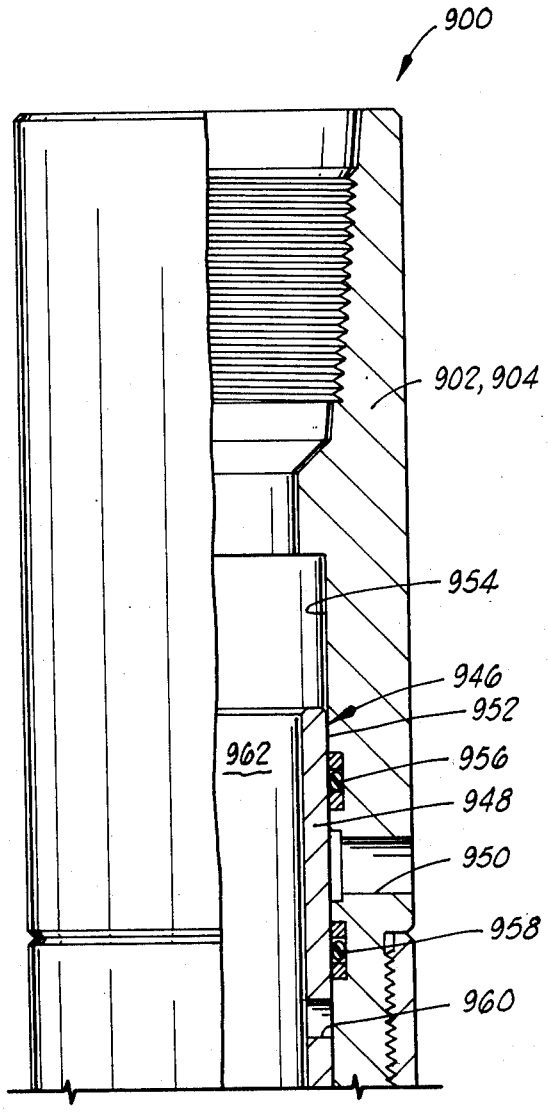
FIGS. 5A–5D comprise an elevation right-side only sectioned view of the upper portion of a fourth embodiment of the present invention. The lower portion of the embodiment of FIGS. 5A–5D is identical to that shown in FIGS. 4E–4I.
Figure 5B:
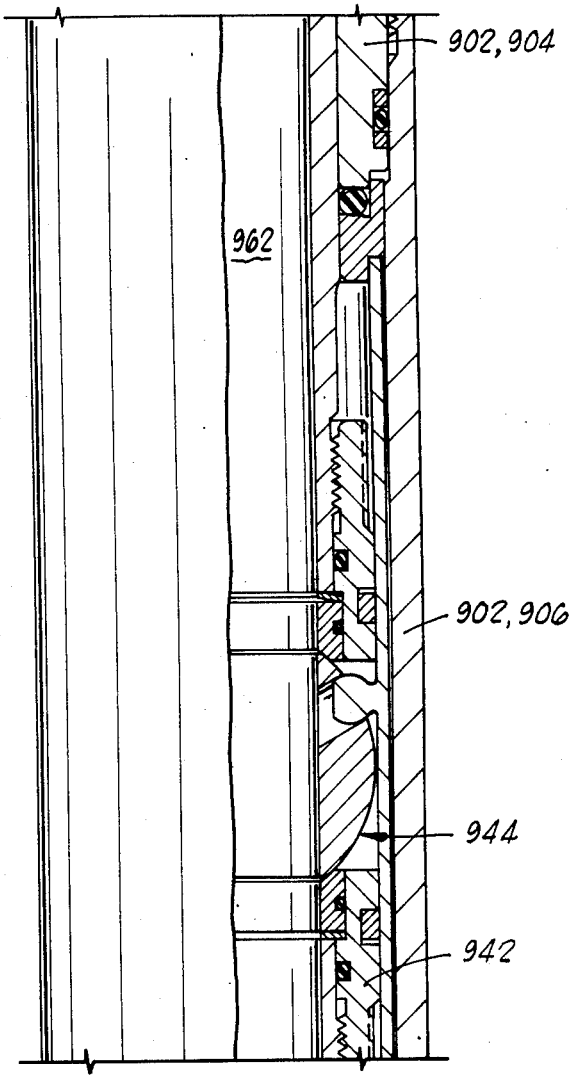
Figure 5C:
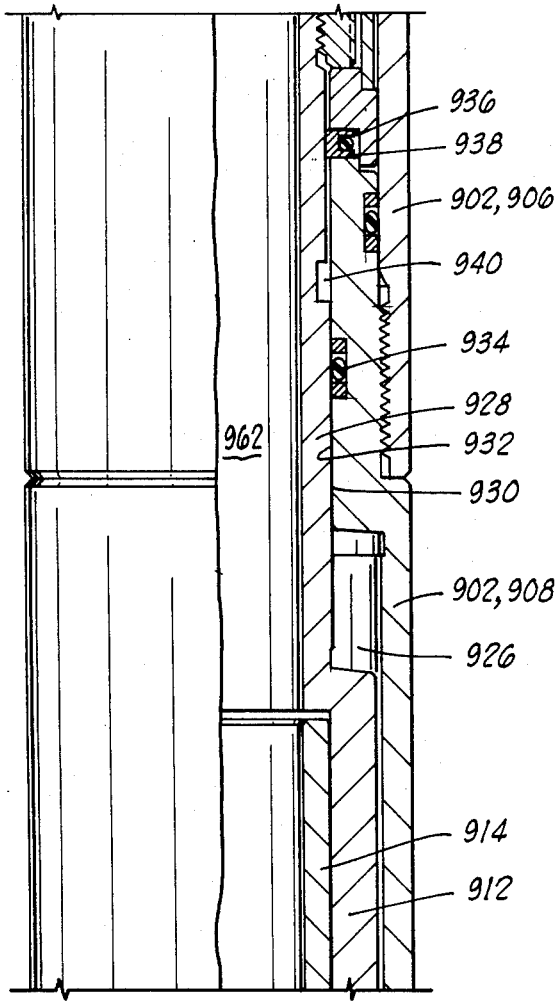
Figure 5D:
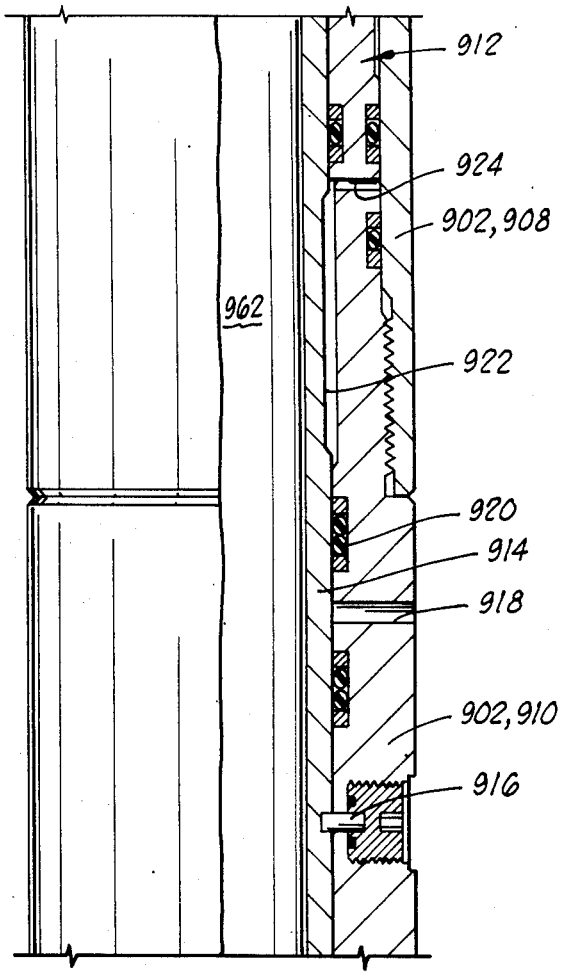

In FIGS. 5B–5D, a second power piston means 912 is thereshown which is substantially similar in its construction to the second power piston means 692 of FIGS. 4C–4D.

A power mandrel extension 914 associated with a lower first power piston (not shown) identical to the first piston 690 of FIG. 4E is very similar to the upper power mandrel extension 740.

It is noted that the shear set 744 of FIG. 4D has been deleted so that the power mandrel extension 914 of FIGS. 5C and 5D is initially retained in place relative to the shear set housing section 910 solely by individual shear pins such as 916 which are constructed and mounted in a manner like that of individual shear pins 726 of FIG. 4D.

Since a typical embodiment of the present invention will only include from three to five shear pins, it is possible to utilize individual shear pins such as 916 circumferentially spaced about the power mandrel extension 914, rather than to use the shear set like shear set 744 of FIG. 4D.

A second power port 918 is disposed through shear set housing section 910 and is initially isolated from second power piston 912 by seal 920.

Seal 920 can generally be described as a prevention means 920 operatively associated with the power mandrel extension 914 of the first power piston means 690 and with the housing 902 for closing the second power port 918 and isolating the lower high pressure side, the lower end 924, of second piston means 912 from the well annulus when the first piston means 690 is in its first position as illustrated in FIGS. 5A–5D.

A reduced diameter of outer surface 922 of power mandrel extension 944 will communicate the second power port 918 with a lower end 924 of second power piston means 912 when the power mandrel extension 914 moves downward relative to the housing 902.

A sealed low pressure chamber 926 containing air at substantially atmospheric pressure is located above the second power piston means 912.

A second power mandrel 928 of second power piston means 912 has an outer cylindrical surface 930 thereof closely and slidably received within a bore 932 of upper power housing section 908 with a seal being provided therebetween by O-ring 934.

A locking means 936 will lock the second power piston means 912 in an uppermost second position thereof when locking dogs 938 are received within a groove 940 of second power mandrel 928.

The second power mandrel 928 has its upper end connected to a lower seat holder 942 of a full opening ball type safety valve means 944 which is constructed substantially identical to the safety valve means 82 of FIG. 1C.

The primary difference of the apparatus 900 as compared to the apparatus 650 of FIGS. 4A–4I is in the construction of the sliding sleeve type circulating valve means 946.

The circulating valve means 946 of the apparatus 900 seen in FIGS. 5A–5B includes a circulating valve sleeve 948 which is fixedly connected to the second power piston means 912 through the safety valve means 944 for longitudinal movement therewith relative to the housing 902.

The circulating valve sleeve 948 is initially in a closed first position blocking the circulating port 950 disposed through upper adapter 904 when the second piston means 912 is in its first position as shown in FIGS. 5A–5D. In this closed first position of the circulating valve means 946, the circulating valve sleeve 948 has a cylindrical outer surface 952 thereof closely received within a bore 954 of upper adapter 904 with O-ring seals 956 and 958 sealing against the sleeve 948 above and below the circulating port 950.

When the second power piston means 912 moves upward, a plurality of sleeve circulating ports 960 disposed through circulating sleeve 948 will be moved into a position between O-ring seals 956 and 958 so as to communicate a central flow passage 962 of the apparatus 900 with the well annulus exterior of the housing 902 through the circulating sleeve ports 960 and the circulating port 950.

It is noted that in the embodiment of FIGS. 5A–5D, the locking means 936 will lock the circulating valve sleeve 948 in its upper second open position with the sleeve circulating ports 960 communicated with the circulating port 950.

The manner of operation of the apparatus 900 is substantially identical to that previously described for the appartaus 650 of FIGS. 4A–4I except for the change in operation of the circulating valve means 946 just described.

Thus it is seen that the apparatus of the present invention readily achieves the ends and advantages mentioned as well as those inherent therein. While certain preferred embodiments of the invention have been illustrated for the purposes of the present disclosure, numerous changes in the arrangement and construction of parts may be made by those skilled in the art which changes are encompassed within the scope and spirit of the present invention as defined by the appended claims.

What is claimed is:

1. An annulus pressure responsive downhole tool apparatus, comprising:

a housing;

an operation element means disposed in said housing and movable from a first element position to a second element position relative to said housing;

a hydrostatic pressure referenced, pressure balanced with respective to hydrostatic pressure, annulus pressure responsive first piston means disposed in said housing, said first piston means being movable from a first to a second position thereof relative to said housing in response to an increase in well annulus pressure;

a lower than hydrostatic referenced annulus pressure responsive second piston means, disposed in said housing and operatively associated with said operating element means, for permitting said operating element means to move from said first element position to said second element position in response to movement of said second piston means from a first position toward a second position thereof relative to said housing; and a prevention means, operatively associated with said first and second piston means, for preventing said seconds piston means from moving to its said second position until said first piston means has moved at least part way toward its said second position.

2. The apparatus of claim 1, wherein:

said second piston means is referenced to substantially atmospheric pressure.

3. The apparatus of claim 1, further comprising:

releasable retaining means, operably associated with said first piston means, for holding said first piston means in said first position thereof until a pressure differential across said first piston means reaches a predetermined value.

4. The apparatus of claim 3, wherein:

said releasable retaining means includes a plurality of shear pins.

5. The apparatus of claim 4, wherein:

said predetermined value is in a range from about 1500 psi to about 2500 psi.

6. The apparatus of claim 5, wherein:

said plurality of shear pins includes a maximum of five individual shear pins.

7. The apparatus of claim 4, wherein:

said hydrostatic referenced annulus pressure responsive five piston means is further characterized as a means for balancing hydrostatic well annulus pressure across said first piston means and thereby preventing said plurality of shear pins from having any substantial force applied thereacross as a result of increasing hydrostatic well annulus pressure as said apparatus is lowered into a well.

8. The apparatus of claim 3, wherein:

said hydrostatic referenced annulus pressure responsive first piston means is further characterized as a means for balancing hydrostatic well annulus pressure across said first piston means and thereby preventing said releasable retaining means from having any substantial force applied thereacross as a result of increasing hydrostatic well annulus pressure as said apparatus is lowered into a well.

9. The apparatus of claim 1, wherein:

said housing has first and second pressure conducting passage means disposed therein for communicating a well annulus exterior of said housing with first and second sides of said hydrostatic referenced annulus pressure responsive first piston means; and said apparatus further comprises a retarding means, disposed in said second pressure conducting passage means, for delaying communication of a sufficient portion of a relatively rapid increase in well annulus pressure to said second side of said first piston means for a sufficient time to allow a pressure differential from said first side to said second side of said first piston means to move said first piston means from its said first position to its said second position.

10. The apparatus of claim 9, wherein:

said retarding means is further characterized as a means for communicating a relatively slow increase in well annulus pressure to said second side of said first piston means quickly enough that a pressure differential across said first piston means is too low to move said first piston means from said first position to said second position thereof, so that hydrostatic well annulus pressure may be substantially balanced across said first piston means as said apparatus is lowered into a well.

11. The apparatus of claim 10, further comprising:

releasable retaining means, operably associated with said first piston means, for holding said first piston means in said first position thereof until a pressure differential across said first piston means reaches a predetermined value.

12. The apparatus of claim 11, wherein:

said retarding means is further characterized as a means for preventing said releasable retaining means from having any substantial force applied thereacross as a result of increasing hydrostatic well annulus pressure as said apparatus is lowered into a well.

13. The apparatus of claim 12, wherein:

said releasable retaining means includes a plurality of shear pins.

14. The apparatus of claim 9, wherein:

said retarding means includes a metering cartridge dividing said second pressure conducting passage means into a first portion between said second side of said first piston means and said metering cartridge, and a second portion between said metering cartridge and said well annulus, said metering cartridge having a pressurizing passage disposed therethrough communicating said first and second portions of said second pressure conducting passage means, and said metering cartridge further including a fluid flow restrictor means disposed in said pressurizing passage for at least temporarily delaying transmission of relatively rapid increases in well annulus pressure to said second side of said first piston means.

15. The apparatus of claim 1, wherein:

said operating element means includes a full opening ball valve;

said ball valve and said second piston means are directly connected together so that they move longitudinally together relative to said housing, said ball valve and said second piston means being so arranged and constructed that said ball valve is moved from an open position to a closed position as said second piston means moves from its first to its second position relative to said housing; and said second piston means is referenced to substantially atmospheric pressure so that said ball valve is relatively rapidly closed by said second piston means.

16. The apparatus of claim 1, wherein:

said operating element means includes both a safety valve means for closing a flow passage through said housing and a circulating valve means for communicating said flow passage above said safety valve means with a well annulus exterior of said housing.

17. The apparatus of claim 16, wherein:

said first element position is defined as an open position of said safety valve means and a closed position of said circulating valve means, and said second element position is defined as a closed position of said safety valve means and an open position of said circulating valve means.

18. The apparatus of claim 16, wherein:

said circulating valve means includes:

a circulating valve sleeve initially located in a closed position closing a circulating port disposed through said housing;

spring biasing means for biasing said circulating valve sleeve toward an open position thereof; and releasable retaining means for initially releasably retaining said circulating valve sleeve in its said closed position; and said apparatus further includes an actuating mandrel, connected to said second piston means for longitudinal movement therewith relative to said housing, said actuating mandrel and said circulating valve sleeve being so arranged and constructed that as said second piston means moves from its said first position to its said second position relative to said housing, said actuating mandrel impacts said circulating valve sleeve to release said releasable retaining means so that said circulating valve sleeve may be moved to its open position by said spring biasing means.

19. The apparatus of claim 16, wherein:

said circulating valve means includes:

a circulating valve sleeve initially located in a closed position closing a circulating port disposed through said housing;

spring biasing means for biasing said circulating valve sleeve toward an open position thereof; and a spring collet including a plurality of spring fingers including enlarged lugs on free ends thereof;

said apparatus further includes an actuating mandrel, connected to said second piston means for longitudinal movement therewith relative to said housing, said actuating mandrel having a main cylindrical outer surface and a reduced diameter cylindrical outer surface; and wherein said housing, said circulating valve sleeve, and said actuating mandrel are so arranged and constructed that when said second piston means is in its said first position said main cylindrical outer surface of said actuating mandrel holds said lugs of said spring collet in a radially outward position wherein said lugs are engaged with an inner shoulder of said housing to initially hold said circulating valve sleeve in its closed position, and when said second piston means moves to its said second position said reduced diameter cylindrical outer surface of said actuating mandrel is aligned with said lugs of said spring collet to allow said lugs to deflect radially inward so that said spring biasing means may move said circulating valve sleeve to its said open position.

20. The apparatus of claim 16, wherein:

said circulating valve means includes a circulating valve sleeve fixedly connected to said second piston means for longitudinal movement therewith relative to said housing, said circulating valve sleeve being in a closed position blocking a circulating port of said housing when said second piston means is in its said first position, and said circulating valve sleeve being in an open position when said second piston means is in its said second position.

21. The apparatus of claim 20, further comprising:

locking means, operably associated with said housing and said second piston means, for locking said second piston means in its said second position, and thereby locking said circulating valve sleeve in its said open position.

22. The apparatus of claim 1, wherein:

said operating element means includes a circulating valve means for communicating a flow passage of said housing with a well annulus exterior of said housing, and said first and second element positions are defined as closed and open positions, respectively, of said circulating valve means.

23. The apparatus of claim 1, further comprising:

locking means, operably associated with said housing and said second piston means, for locking said second piston means in its said second position.

24. The apparatus of claim 1, wherein:

said prevention means includes a releasable mechanical locking means for releasably locking said second piston means to said housing so that said second piston means is held in its said first position so long as said first piston means is in its said first position.

25. The apparatus of claim 24, wherein:

said releasable mechanical locking means includes a spring collet connected to said second piston means, said spring collet having a plurality of spring fingers with enlarged lugs on free ends thereof; and said housing, said first and second piston means, and said spring collet are so arranged and constructed that when said first piston means is in its said first position, said first piston means holds said lugs of said spring fingers in a radially outward position wherein said lugs engage a radially inner shoulder of said housing, and when said first piston means moves toward its said second position, said lugs are released so that they may deflect radially inward.

26. The apparatus of claim 24, wherein:

said housing has a power passage disposed therethrough which always communicates a well annulus with a high pressure side of said second piston means.

27. The apparatus of claim 1, wherein:

said housing has a power passage disposed therethrough for communicating a well annulus exterior of said housing with a high pressure side of said second piston means; and said prevention means includes seal means, operatively associated with said first piston means and said housing, for closing said power passage and isolating said high pressure side of said second piston means from said well annulus when said first piston means is in its said first position.

28. The apparatus of claim 27, wherein:

said power passage is characterized as a second power passage associated with said second piston means; and said housing has an unobstructed first power passage disposed therethrough for constantly communicating said well annulus with a high pressure side of said first piston means, said first and second power passages being isolated from each other within said housing.

29. The apparatus of claim 27, further comprising an elongated power mandrel fixedly connected to said first piston means, said power mandrel having a bypass passage means defined thereon for allowing well annulus fluid to bypass said seal means so that said high pressure side of said second piston means is communicated with said well annulus when said first piston means moves to its said second position.

30. The apparatus of claim 29, wherein:

said power mandrel has a main cylindrical outer surface which sealingly engages said seal means to block said power passage when said first piston means is in its said first position; and said bypass passage means of said power mandrel is a reduced diameter cylindrical outer surface thereof adjacent said main cylindrical outer surface thereof.

31. The apparatus of claim 1, further comprising:

an elongated power mandrel extending from said first piston means, said first piston means and said power mandrel being fixed relative to each other so that they move together longitudinally relative to said housing, said power mandrel being concentrically located within said housing and defining an annular space between a first cylindrical outer surface of said power mandrel and a cylindrical inner surface of said housing; and wherein said second piston means is an annular second piston means slidably received in said annular space and said second piston means includes outer and inner annular seal means for providing a sliding seal between said second piston means and each of said cylindrical inner surface of said housing and said first cylindrical outer surface of said power mandrel, respectively.

32. The apparatus of claim 31, wherein:

said first and second piston means are so arranged and constructed that when said first piston means moves from its said first position to its said second position, it moves in a first longitudinal direction, and when said second piston means moves from its said first position to its said second position, it moves in a second longitudinal direction opposite said first longitudinal direction.

33. The apparatus of claim 32, wherein:

said housing has a power port disposed therethrough; and said prevention means includes a seal means for sealing between said housing and said power mandrel when said first piston means is in its said first position and for thereby isolating said second piston means from said power port when said first piston means is in its said first position.

34. The apparatus of claim 33, wherein:

said power mandrel includes a reduced diameter portion for communicating said power port with said second piston means when said first piston means is in its said second position.

35. An annulus pressure responsive downhole tool apparatus, comprising:

a housing having a circulating port disposed through a wall thereof and having a central flow passage disposed longitudinally therethrough;

a circulating valve sleeve disposed in said housing and irreversibly movable from a closed position wherein said circulating port is blocked to an open position wherein said circulating port is open;

a rotatable full opening ball valve disposed in said flow passage and irreversibly movable from an open position wherein said flow passage is open to a closed position wherein said flow passage is closed; and a hydrostatic pressure referenced, pressure balanced with respect to hydrostatic pressure, annulus pressure responsive first piston means movable between first and second positions thereof relative to said housing in response to an increase in well annulus pressure, said first piston means being operatively associated with said circulating valve sleeve and said ball valve for retaining said circulating valve sleeve in its closed position and said ball valve in its open position so long as said first piston means is in its first position.

36. The apparatus of claim 35, wherein:

said housing has first and second pressure conducting passage means disposed therein for communicating a well annulus exterior of said housing with first and second sides, respectively, of said first piston means; and said apparatus further includes a selectively actuatable one-way check valve means associated with said second pressure conducting passage means for preventing flow of fluid from said well annulus to said second side of said first piston means so that after said check valve is actuated, an increase in well annulus pressure will create a pressure differential from said first side toward said second side of said first piston means.

37. The apparatus of claim 36, wherein said check valve means includes:

a sliding valve member disposed in said second fluid conducting passage means and movable from a first position wherein said second fluid conducting passage means is open, to a second position wherein said second fluid conducting passage means is closed;

spring biasing means for biasing said sliding valve member toward its said first position; and a restricted area flow passage disposed through said sliding valve member for permitting relatively slow increases in well annulus pressure to be transmitted therethrough to said second side of said first piston means, and for delaying communication of a relatively rapid increase in well annulus pressure therethrough so as to create a pressure differential sufficient to overcome said spring biasing means and to move said sliding valve member to its second position to thereby prevent any further flow of fluid from said well annulus to said second side of said first piston means.

38. The apparatus of claim 36, wherein:

said housing includes first and second longitudinally telescoping portions, said check valve means being mounted on said first portion, and an open end of said second pressure conducting passage means being defined in said second portion; and said housing and said check valve means are so arranged and constructed that when said first and second portions of said housing are in a telescopingly extending position, said open end of said second pressure conducting passage means is open to said well annulus, and when said first and second portions of said housing are in a telescopingly retracted position, said check valve means covers said open end of said second pressure conducting passage means.

39. The apparatus of claim 38, further comprising:

a metering cartridge means, fixed to one of said first and second portions of said housing and disposed in said second pressure conducting passage means, for providing a time delay in movement of said first and second portions from said telescopingly extended position to said telescopingly retracted position, so that said first and second portions of said housing will remain in said telescopingly extended position as said apparatus is run into a well.

40. The apparatus of claim 35, wherein:

said housing has first and second pressure conducting passage means disposed therein for communicating a well annulus exterior of said housing with first and second sides of said hydrostatic referenced annulus pressure responsive first piston means; and said apparatus further comprises a retarding means, disposed in said second pressure conducting passage means, for delaying communication of a sufficient portion of a relatively rapid increase in well annulus pressure to said second side of said first piston means for a sufficient time to allow a pressure differential from said first side to said second side of said first piston means to move said first piston means from its said first piston position to its said second piston position.

41. The apparatus of claim 40, wherein:

said retarding means is further characterized as a means for communicating a relatively slow increase in well annulus pressure to said second side of said first piston means quickly enough that a pressure differential across said first piston means is too low to move said first piston means from said first position to said second position thereof, so that hydrostatic well annulus pressure may be substantially balanced across said first piston means as said apparatus is lowered into a well.

42. The apparatus of claim 40, wherein:

said retarding means includes a metering cartridge dividing said second pressure conducting passage means into a first portion between said second side of said first piston means and said metering cartridge, and a second portion between said metering cartridge and said well annulus, said metering cartridge having a pressurizing passage disposed therethrough communicating said first and second portions of said second pressure conducting passage means, and said metering cartridge further including a fluid flow restrictor means disposed in said pressurizing passage for at least temporarily delaying transmission of increases in well annulus pressure to said second side of said first piston means.

43. The apparatus of claim 42, further comprising:

upper and lower floating pistons disposed in said second pressure conducting passage means above and below said metering cartridge;

wherein a portion of said second pressure conducting passage means between said first piston means and said upper floating piston is filled with a compressible gas; and wherein a portion of said second pressure conducting passage means between said upper and lower floating pistons is filled with liquid.

44. The apparatus of claim 35, further comprising:

an annulus pressure responsive second piston means, disposed in said housing and operatively associated with said first piston means and both said circulating valve sleeve and said ball valve for permitting said circulating valve sleeve to irreversibly move from said closed position to said open position thereof and for permitting said ball valve to move from said open position to said closed position thereof in response to movement of said second piston means from a first position thereof toward a second position thereof relative to said housing; and a prevention means, operatively associated with said first and second piston means, for preventing said second piston means from moving to its said second position until said first piston means has moved at least part way toward its said second position.

45. The apparatus of claim 44, further comprising:

locking means, operably associated with said housing and said second piston means, for locking said second piston means in its said second position.

46. The apparatus of claim 44, wherein:

said prevention means includes a releasable mechanical locking means for releasably locking said second piston means to said housing so that said second piston means is held in its said first position so long as said first piston means is in its said first position.

47. The apparatus of claim 46, wherein:

said releasable mechanical locking means includes a spring collet connected to said second piston means, said spring collet having a plurality of spring fingers with enlarged lugs on free ends thereof; and said housing, said first and second piston means, and said spring collet are so arranged and constructed that when said first piston means is in its said first position, said first piston means holds said lugs of said spring fingers in a radially outward position wherein said lugs engage a radially inner shoulder of said housing, and when said first piston means moves toward its said second position, said lugs are released so that they may deflect radially inward.

48. The apparatus of claim 46, wherein:

said housing has a power passage disposed therethrough which always communicates a well annulus with a high pressure side of said second piston means.

49. The apparatus of claim 44, wherein:

said housing has a power passage disposed therethrough for communicating a well annulus exterior of said housing with a high pressure side of said second piston means; and said prevention means includes seal means, operatively associated with said first piston means and said housing, for closing said power passage and isolating said high pressure side of said second piston means from said well annulus when said first piston means is in its said first position.

50. The apparatus of claim 49, wherein:

said power passage is characterized as a second power passage associated with said second piston means; and said housing has an unobstructed first power passage disposed therethrough for constantly communicating said well annulus with a high pressure side of said first piston means, said first and second power passages being isolated from each other within said housing.

51. The apparatus of claim 49, further comprising an elongated power mandrel fixedly connected to said first piston means, said power mandrel having a bypass passage means defined thereon for allowing well annulus fluid to bypass said seal means so that said high pressure side of said second piston means is communicated with said well annulus when said first piston means moves to its said second position.

52. The apparatus of claim 51, wherein:

said power mandrel has a main cylindrical outer surface which sealingly engages said seal means to block said power passage when said first piston means is in its said first position; and said bypass passage means of said power mandrel is a reduced diameter cylindrical outer surface thereof adjacent said main cylindrical outer surface thereof.

53. An annulus pressure responsive downhole tool apparatus, comprising:

a housing;

an operating element means disposed in said housing and movable from a first element position to a second element position relative to said housing;

an annulus pressure responsive first piston means disposed in said housing, said first piston means being movable from a first to a second position thereof relative to said housing in response to an increase in well annulus pressure;

an elongated power mandrel extending from said first piston means, said first piston means and said power mandrel being fixed relative to each other so that they move together longitudinally relative to said housing, said power mandrel being concentrically located within said housing and defining an annular space between a first cylindrical outer surface of said power mandrel and a cylindrical inner surface of said housing; and an annulus pressure responsive second piston means slidably received in said annular space, said second piston means includes outer and inner annular seal means for providing a sliding seal between said second piston means and each of said cylindrical inner surface of said housing and said first cylindrical outer surface of said power mandrel, respectively, said second piston means being movable from a first to a second position thereof in response to said increase in well annulus pressure;

a prevention means, operatively associated with said first and second piston means, for preventing said second piston means from moving to its said second position until said first piston means has moved at least part way toward its said second position; and wherein said second piston means is operatively associated with said operating element means, so that said operating element means is permitted to move from its said first element position to its said second element position in response to movement of said second piston means from its said first position toward its said second position.

54. The apparatus of claim 53, wherein:

said first and second piston means are so arranged and constructed that when said first piston means moves from its said first position to its said second position, it moves in a first longitudinal direction, and when said second piston means moves from its said first position to its said second position, it moves in a second longitudinal direction opposite said first longitudinal direction.

55. The apparatus of claim 54, wherein:

said housing has a power port disposed therethrough; and said prevention means includes a seal means for sealing between said housing and said power mandrel when said first piston means is in its said first position and for thereby isolating said second piston means from said power port when said first piston means is in its said first position.

56. The apparatus of claim 55, wherein:

said power mandrel includes a reduced diameter portion for communicating said power port with said second piston means when said first piston means is in its said second position.

57. The apparatus of claim 56, wherein:

said first piston means is referenced to well annulus hydrostatic pressure.

58. The apparatus of claim 57, wherein:

said second piston means is referenced to substantially atmospheric pressure.

59. The apparatus of claim 56, wherein:

said operating element means is irreversibly movable from said first element position to said second element position.

60. The apparatus of claim 56, further comprising:

releasable retaining means, operably associated with said first piston means, for holding said first piston means in said first position thereof until a pressure differential across said first piston means reaches a predetermined value.

61. The apparatus of claim 60, wherein:

said releasable retaining means includes a plurality of shear pins.

62. The apparatus of claim 56, wherein:

said operating element means includes both a safety valve means for closing a flow passage through said housing and a circulating valve means for communicating said flow passage above said safety valve means with a well annulus exterior of said housing.

63. The apparatus of claim 62, wherein:

said circulating valve means includes:

a circulating valve sleeve initially located in a closed position closing a circulating port disposed through said housing;

spring biasing means for biasing said circulating valve sleeve toward an open position thereof;

a spring collet including a plurality of spring fingers including enlarged lugs on free ends thereof;

said apparatus further includes an actuating mandrel, connected to said second piston means for longitudinal movement therewith relative to said housing, said actuating mandrel having a main cylindrical outer surface and a reduced diameter cylindrical outer surface; and wherein said housing, said circulating valve sleeve, and said actuating mandrel are so arranged and constructed that when said second piston means is in its said first position said main cylindrical outer surface of said actuating mandrel holds said lugs of said spring collet in a radially outward position wherein said lugs are engaged with an inner shoulder of said housing to initially hold said circulating valve sleeve in its closed position, and when said second piston means moves to its said second position said reduced diameter cylindrical outer surface of said actuating mandrel is aligned with said lugs of said spring collet to allow said lugs to deflect radially inward so that said spring biasing means may move said circulating valve sleeve to its said open position.

64. The apparatus of claim 62, wherein:

said circulating valve means includes a circulating valve sleeve fixedly connected to said second piston means for longitudinal movement therewith relative to said housing, said circulating valve sleeve being in a closed position blocking a circulating port of said housing when said second piston means is in its said first position, and said circulating valve sleeve being in an open position when said second piston means is in its said second position.

65. The apparatus of claim 64, further comprising:

locking means, operably associated with said housing and said second piston means, for locking said second piston means in its said second position, and thereby locking said circulating valve sleeve in its said open position.

* * * * *

UNITED STATES PATENT AND TRADEMARK OFFICE

CERTIFICATE OF CORRECTION

PATENT NO. : 4,691,779

DATED : September 8, 1987

INVENTOR(S) : Michael E. McMahan et al.

It is certified that error appears in the above-identified patent and that said Letters Patent is hereby corrected as shown below:

In column 18, line 13, delete the numeral [530] and insert therefor --520--.

In column 18, line 29, delete the word [connecting] and insert therefor --conducting--.

In column 21, line 68, delete the numeral [680] and insert therefor --650--.

In column 27, line 56, delete the word [five] and insert therefor --first--.

Signed and Sealed this

Nineteenth Day of January, 1988

*Attest:*

*Attesting Officer*

DONALD J. QUIGG

*Commissioner of Patents and Trademarks*